US009339700B2

(12) United States Patent
Oyama

(10) Patent No.: US 9,339,700 B2
(45) Date of Patent: May 17, 2016

(54) GOLF CLUB

(71) Applicant: Dunlop Sports Co. Ltd., Kobe-shi, Hyogo (JP)

(72) Inventor: Hitoshi Oyama, Kobe (JP)

(73) Assignee: DUNLOP SPORTS CO., LTD., Kobe-Shi (JP)

( * ) Notice: Subject to any disclaimer, the term of this patent is extended or adjusted under 35 U.S.C. 154(b) by 0 days.

(21) Appl. No.: 14/618,710

(22) Filed: Feb. 10, 2015

(65) Prior Publication Data

US 2015/0151170 A1 Jun. 4, 2015

Related U.S. Application Data

(62) Division of application No. 13/041,632, filed on Mar. 7, 2011.

(30) Foreign Application Priority Data

Mar. 8, 2010 (JP) ..... 2010-050963

(51) Int. Cl.
*A63B 53/10* (2015.01)
*A63B 53/02* (2015.01)
*A63B 53/00* (2015.01)

(52) U.S. Cl.
CPC ..... *A63B 53/02* (2013.01); *A63B 53/10* (2013.01); *A63B 2053/002* (2013.01)

(58) Field of Classification Search
CPC ..... A63B 53/02; A63B 2209/02; A63B 2053/002; A63B 53/10
See application file for complete search history.

(56) References Cited

U.S. PATENT DOCUMENTS

| | | | | |
|---|---|---|---|---|
| 5,242,721 | A | 9/1993 | Oonuki et al. | |
| 5,348,777 | A | 9/1994 | Oonuki et al. | |
| 6,183,374 | B1 | 2/2001 | Onuki et al. | |
| 6,773,358 | B1 | 8/2004 | Sumitomo et al. | |
| 7,326,126 | B2 | 2/2008 | Holt et al. | |
| 2004/0018886 | A1 | 1/2004 | Burrows | |
| 2004/0018887 | A1 | 1/2004 | Burrows | |
| 2005/0049072 | A1 | 3/2005 | Burrows | |
| 2006/0105855 | A1 | 5/2006 | Cackett et al. | |
| 2009/0011849 | A1 | 1/2009 | Thomas et al. | |
| 2010/0160068 | A1 | 6/2010 | Stites et al. | |
| 2012/0169869 | A1* | 7/2012 | You | A63B 53/10 348/142 |

FOREIGN PATENT DOCUMENTS

| | | | |
|---|---|---|---|
| JP | 3-227616 | A | 10/1991 |
| JP | 10-328338 | A | 12/1998 |
| JP | 11-76480 | A | 3/1999 |
| JP | 11-299944 | A | 11/1999 |

(Continued)

*Primary Examiner* — Stephen Blau
(74) *Attorney, Agent, or Firm* — Birch, Stewart, Kolasch & Birch, LLP

(57) ABSTRACT

A golf club 2 is provided with a head 4 having a hosel hole 18 and a shaft 6. The golf club 2 has a mounting/detaching mechanism detachably mounting the head 4 and the shaft 6 to each other. The mounting/detaching mechanism can fix the shaft 6 to the hosel hole 18 of the head 4 at a plurality of circumferential mounting positions. The shaft 6 has anisotropy producing coupled deformations of bending and torsion. Preferably, an angle θ1 between an axis line of the shaft 6 and an axis line of the hosel hole 18 is 0 degree. Preferably, a bending torsional amount of the shaft 6 is equal to or greater than 0.5 degree.

16 Claims, 17 Drawing Sheets

(56) References Cited

FOREIGN PATENT DOCUMENTS

| | | | |
|---|---|---|---|
| JP | 2000-5349 | A | 1/2000 |
| JP | 2000-325512 | A | 11/2000 |
| JP | 2001-104521 | A | 4/2001 |
| JP | 2003-058584 | A | 2/2003 |
| JP | 2003-265661 | A | 9/2003 |
| JP | 2005-270402 | A | 10/2005 |
| JP | 2005-533626 | A | 11/2005 |
| JP | 2006-42951 | A | 2/2006 |
| JP | 2008-520274 | A | 6/2008 |
| WO | WO 2004/009186 | A1 | 1/2004 |
| WO | WO 2009/009291 | A1 | 1/2009 |

* cited by examiner

GOLF CLUB

CROSS REFERENCE TO RELATED APPLICATIONS

This application is a divisional of U.S. patent application Ser. No. 13/041,632 filed on Mar. 7, 2011, which claims priority to Patent Application No. 2010-050963 filed in JAPAN on Mar. 8, 2010, the entire contents of which are hereby incorporated by reference.

BACKGROUND OF THE INVENTION

1. Field of the Invention

The present invention relates to a golf club. In particular, the present invention relates to a golf club in which a head and a shaft are detachably mounted to each other.

2. Description of the Related Art

A golf club in which a head and a shaft are detachably mounted to each other has been proposed. Easiness in detachably mounting the shaft to the head body is useful for several reasons. If golf players themselves detachably mount the shaft to the head easily, the golf players can change the head and the shaft easily. For example, golf players who cannot satisfy the performance of the purchased golf club easily change the head and the shaft by themselves. The golf players themselves can easily assemble an original golf club in which a favorite head and a favorite shaft are combined. The golf players can purchase the favorite head and the favorite shaft, and can assemble the head and the shaft by themselves. Stores which sell the golf clubs can select the combination of the head and the shaft properly corresponding the golf player, and sell the combination. The head and the shaft detachably mounted easily facilitate the custom-made golf club.

Japanese Patent Application National Publication (Laid-Open) No. 2008-520274 (US 2006/105855), Japanese Patent Application National Publication (Laid-Open) No. 2005-533626 (WO2004/009186), and Japanese Patent Application Laid-Open No. 2006-42951 disclose structures where a head and a shaft are easily mounted and detached.

Furthermore, Japanese Patent Application Laid-Open Nos. 2000-5349 and 2005-270402, and WO2009/009291 (PCT application) disclose a golf club having an angle θ1 between a shaft axis and a hosel axis in a mounting/detaching mechanism of a head and a shaft. In these inventions, a loft angle, a lie angle, and a hook angle (face angle) can be adjusted by a circumferential position of the shaft.

On the other hand, a shaft having a property producing coupled deformations of bending and torsion has been proposed. The property is also referred to as "anisotropy" in the present application. The shaft having the anisotropy is also referred to as an "anisotropic shaft". The shafts having the anisotropy are disclosed in Japanese Patent Application Laid-Open Nos. 3-227616 (U.S. Pat. No. 5,348,777, U.S. Pat. No. 5,242,721), 11-76480, 11-299944 (U.S. Pat. No. 6,773,358), and 2003-265661. These anisotropic shafts can correct hook and slice.

SUMMARY OF THE INVENTION

In the golf club having the angle θ1, angle adjustment corresponding to a golf player is enabled by changing the circumferential position of the shaft. For example, the hook angle (face angle) can be adjusted.

However, in the club having the hook angle (face angle) thus adjusted, a direction of a face at address may generate discomfort. Particularly, a great angle θ1 between the hosel axis and the shaft axis is apt to generate the discomfort. Due to the discomfort, the golf player may feel difficulty of addressing. The discomfort and the difficulty of addressing may hinder a smooth swing.

The adjustment effect of the hook angle (face angle) is effective for a golf player grounding a sole at address. However, the adjustment effect is hardly effective for a golf player who does not ground the sole at address.

It is an object of the present invention to provide a golf club capable of improving a correcting effect of hook and slice.

A golf club of the present invention is provided with a head having a hosel hole and a shaft. The golf club has a mounting/detaching mechanism detachably mounting the head and the shaft to each other. The mounting/detaching mechanism can fix the shaft to the hosel hole of the head at a plurality of circumferential mounting positions. The shaft has anisotropy producing coupled deformations of bending and torsion.

Preferably, an angle θ1 between an axis line of the shaft and an axis line of the hosel hole is 0 degree.

Preferably, the mounting/detaching mechanism comprises a sleeve fixed to a tip part of the shaft, a rotation-preventing part regulating relative rotation between the sleeve and the hosel hole, and a coming-off preventing part regulating axial relative movement between the sleeve and the hosel hole. Preferably, the rotation-preventing part and the coming-off preventing part can fix the shaft to the hosel hole of the head at the plurality of circumferential mounting positions.

Preferably, a bending torsional amount of the shaft is equal to or greater than 0.5 degree.

The present invention can provide a golf club having little discomfort at address and having a high correcting effect of hook or slice.

DESCRIPTION OF THE PREFERRED EMBODIMENTS

Hereinafter, the present invention will be described below in detail based on preferred embodiments with reference to the drawings.

Figure 1:
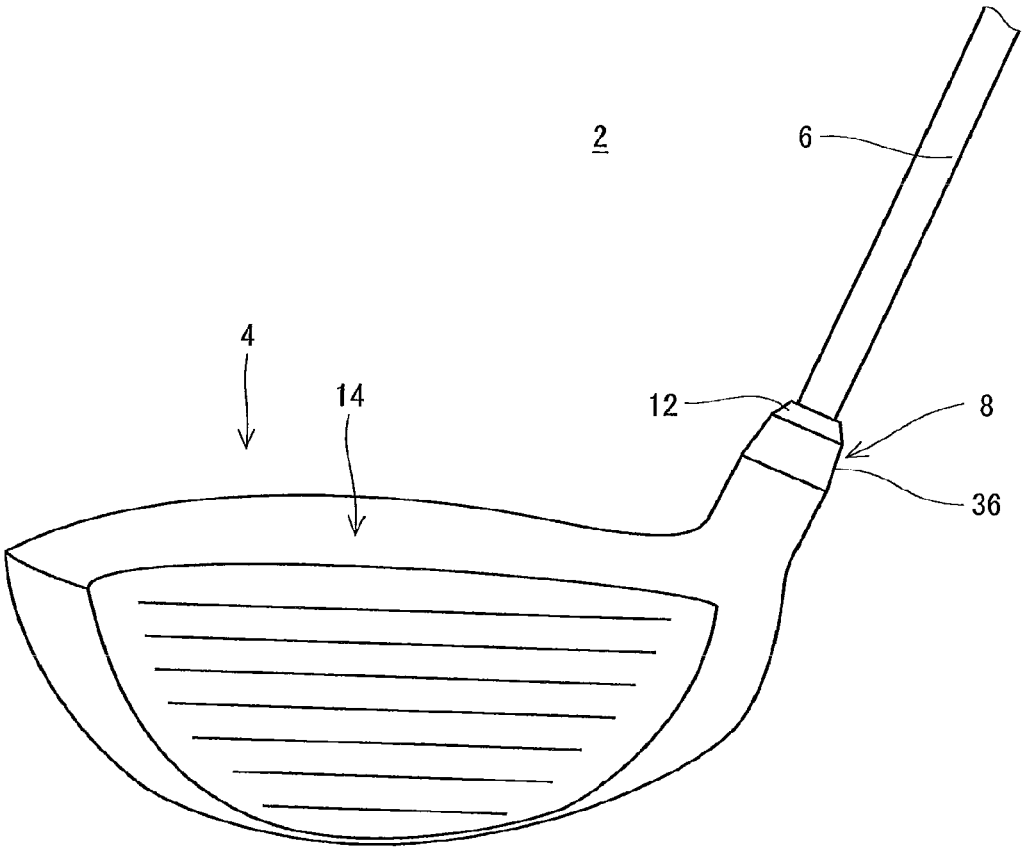
FIG. 1 is a view showing a golf club according to one embodiment of the present invention.
Figure 2:
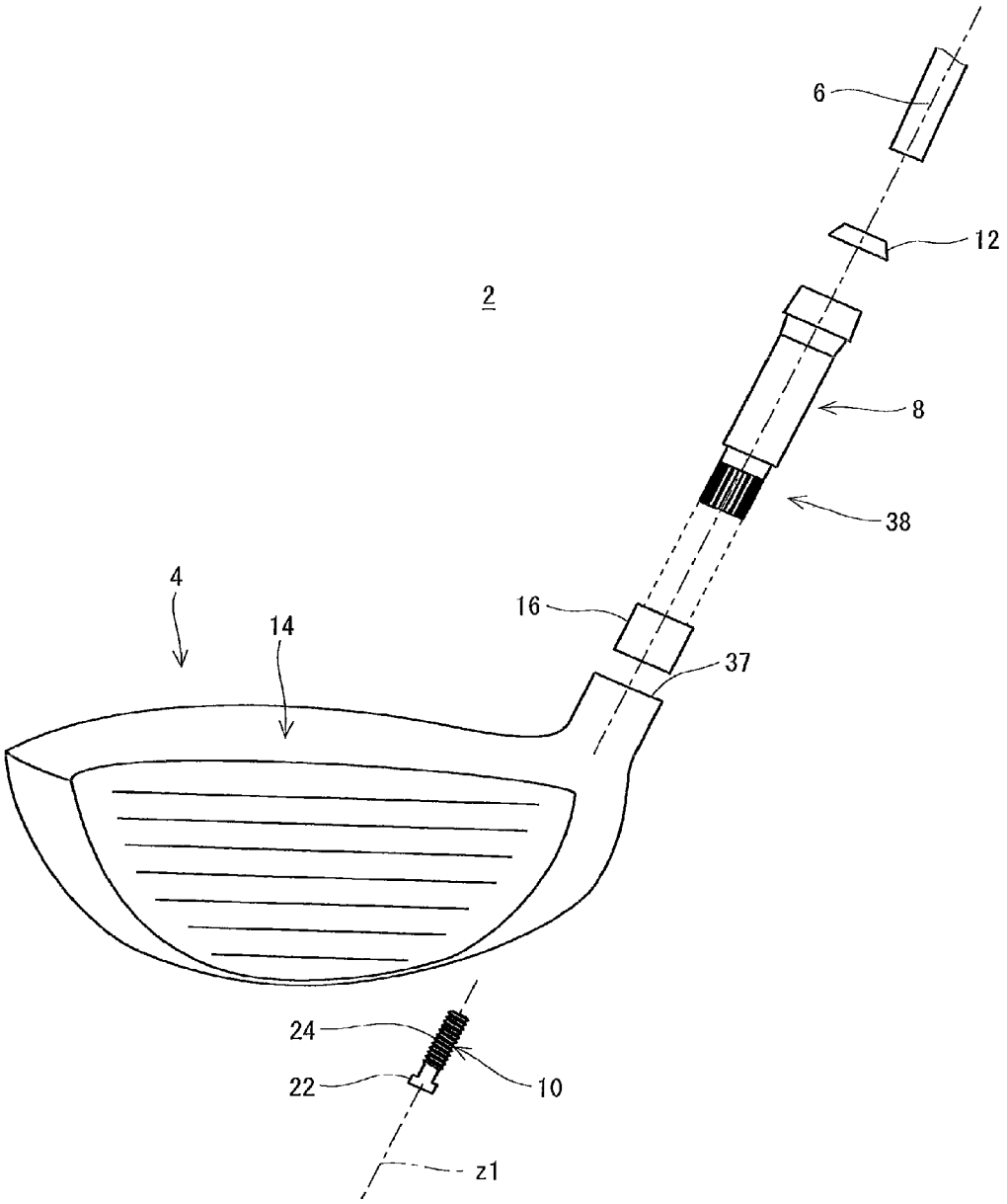
FIG. 2 is an exploded view of FIG. 1.
Figure 3:
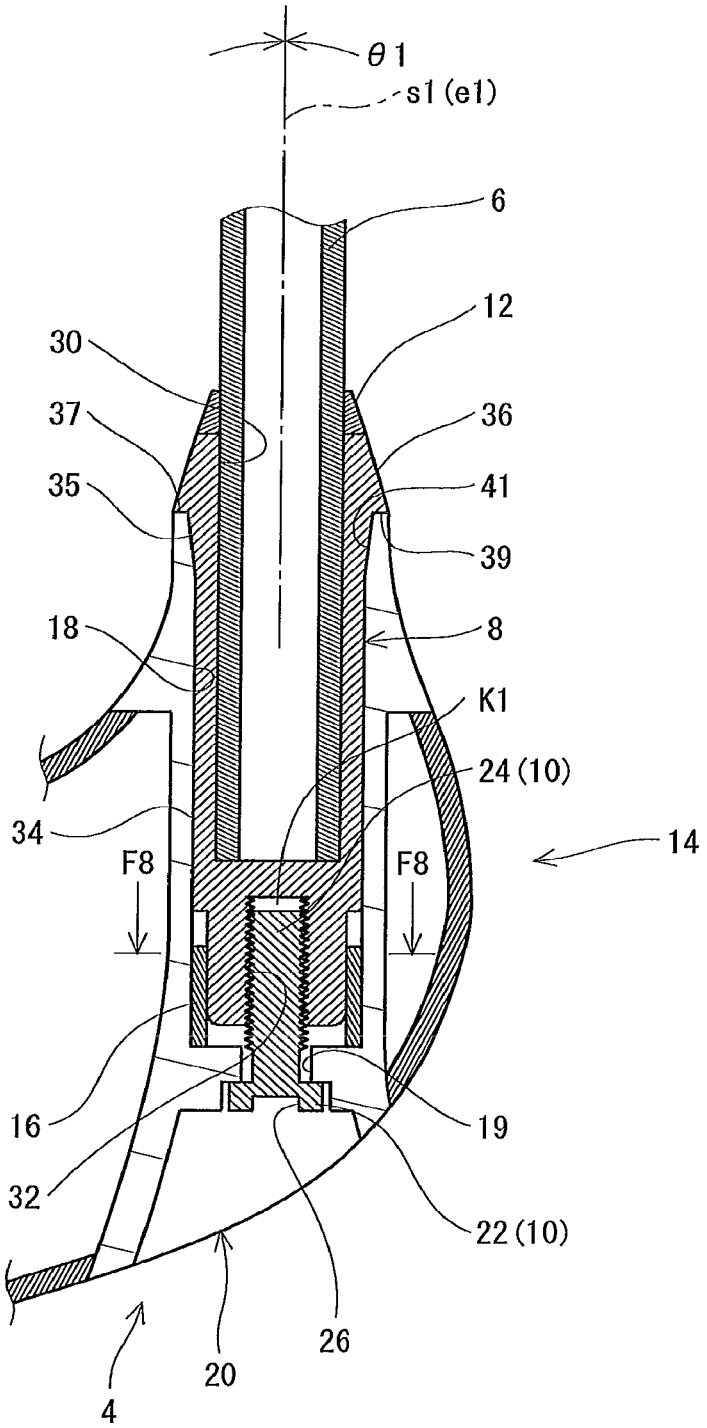
FIG. 3 is a sectional view of FIG. 1.

FIG. 1 shows only a vicinity of a head of a golf club 2. FIG. 2 is an exploded view of the golf club 2. FIG. 3 is a sectional view of the golf club 2. FIG. 3 is a sectional view along a center axis line of a sleeve 8.

The golf club 2 has a head 4, a shaft 6, a sleeve 8, a screw 10, and a ferrule 12. The sleeve 8 is fixed to a tip of the shaft 6. A grip (not shown) is mounted to a back end of the shaft 6.

The head 4 has a head body 14 and an engaging member 16. The head body 14 has a hosel hole 18 into which the sleeve 8 is inserted, and a through hole 19 into which the screw 10 is inserted. The through hole 19 passes through a bottom part of the hosel hole 18. The head body 14 has a sole hole 20 opened in a sole (see FIG. 3). The sole hole 20 and the hosel hole 18 are continued through the through hole 19. The head body 14 has a hollow part.

The type of the head 4 is not restricted. The head 4 of the embodiment is a wood type golf club. The head 4 may be a utility type head, a hybrid type head, an iron type head, and a putter head or the like.

The shaft 6 is not restricted. A generalized carbon shaft, and a steel shaft or the like can be used. The shaft 6 of the embodiment is a carbon shaft.

The screw 10 has a head part 22 and an axis part 24 (see FIG. 2). The screw 10 passes through the through hole 19 from the sole hole 20, and reaches to a screw hole 32 (to be described later). The axis part 24 is connected to the sleeve 8 in a screwing manner (to be described in detail later). The head part 22 has a recess part 26 for a wrench (see FIG. 3). The screw 10 located in the head body 14 can be axially rotated by using the wrench (a hexagonal wrench, and a dedicated wrench or the like) fitted into the recess part 26. This axial rotation enables mounting and detaching of the sleeve 8.

The engaging member 16 is fixed to the head body 14 (see FIG. 3). The fixing method is not restricted. As the fixing method, bonding, welding, fitting, and a combination thereof are exemplified. The engaging member 16 is put into the hosel hole 18 from an upper side opening of the hosel hole 18. The engaging member 16 is fixed to a bottom part of the hosel hole 18.

The engaging member 16 has a rotation-preventing part. The rotation-preventing part is formed in the inner surface of the engaging member 16. The rotation-preventing part will be described later.

Figure 4:
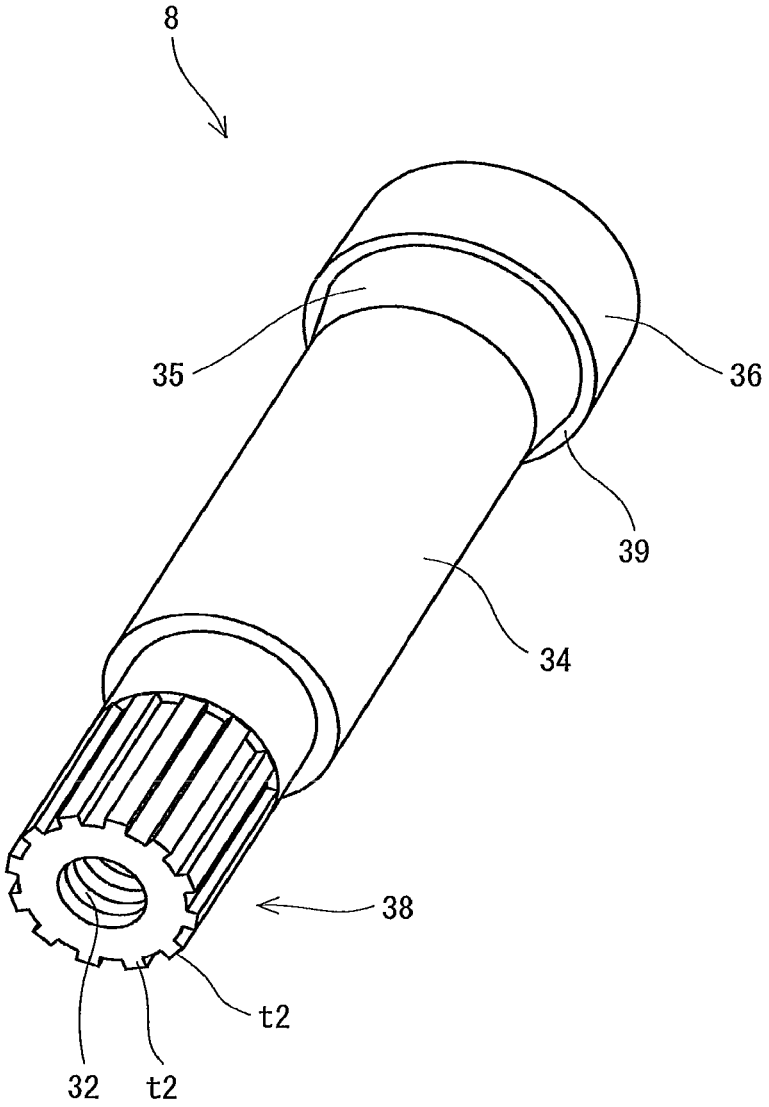
FIG. 4 is a perspective view showing an example of a sleeve.
Figure 5:
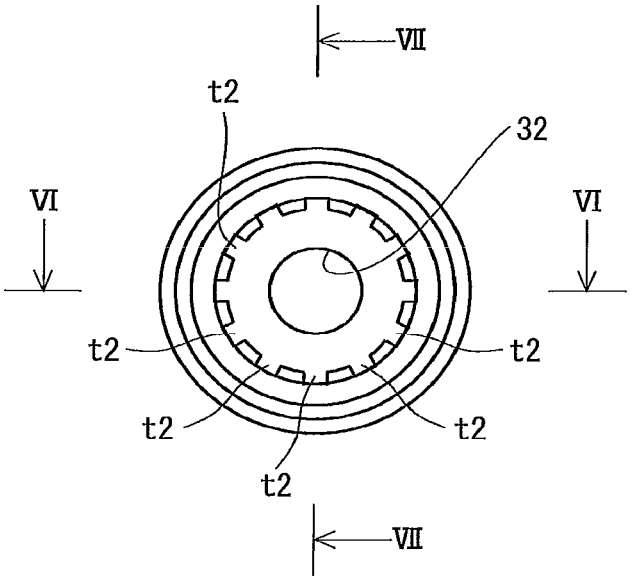
FIG. 5 is a bottom view of the sleeve of FIG. 4.
Figure 6:
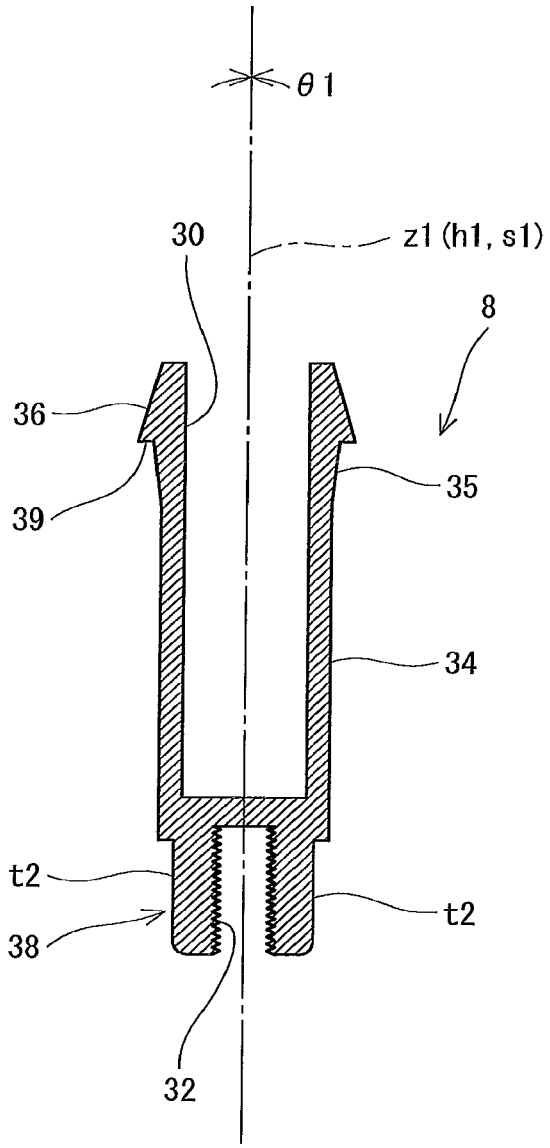
FIG. 6 is a sectional view taken along line VI-VI of FIG. 5.
Figure 7:
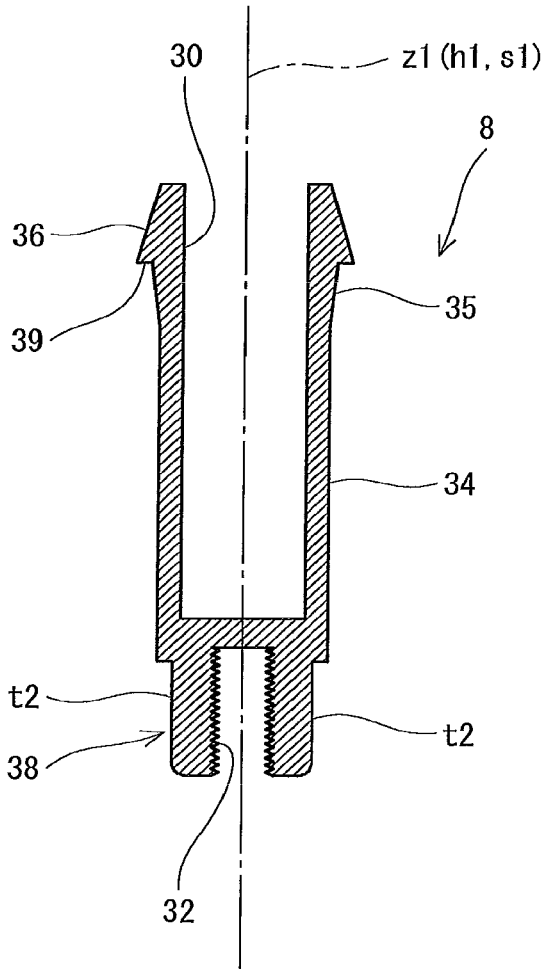
FIG. 7 is a sectional view taken along line VII-VII of FIG. 5.

FIG. 4 is a perspective view of the sleeve 8. FIG. 5 is a bottom view of the sleeve 8. FIG. 6 is a sectional view taken along line VI-VI of FIG. 5. FIG. 7 is a sectional view taken along line VII-VII of FIG. 5.

The sleeve 8 has a shaft hole 30 and the screw hole 32 (FIGS. 6 and 7). The shaft hole 30 is opened to one side (an upper side). The screw hole 32 is opened to other side (a lower side). The screw hole 32 is disposed on the lower side of the shaft hole 30.

The sleeve 8 further has a definite-diameter circumferential surface 34, an inclined surface 35, an exposed surface 36, and a rotation-preventing part 38. The definite-diameter circumferential surface 34 is a portion having a fixed outer diameter. A bump surface 39 exists on the lower end of the exposed surface 36.

In a state where the shaft is mounted (see FIGS. 1 and 3), the exposed surface 36 is exposed to the outside. An outer diameter of a lower end of the exposed surface 36 is substantially equal to an outer diameter of a hosel end surface 37. An outer diameter of an upper end of the exposed surface 36 is substantially equal to an outer diameter of a lower end of the ferrule 12. The exposed surface 36 and the ferrule 12 look like a conventional ferrule as a whole. The exposed surface 36 enhances appearance.

A lower portion of the sleeve 8 than the exposed surface 36 is inserted into the hosel hole 18 (see FIG. 3). A shape of the inclined surface 35 corresponds to a shape of a chamfering part 41 of the hosel hole 18 (see FIG. 3).

As shown in FIGS. 6, 7, an axis line h1 of the shaft hole 30 is not inclined to an axis line z1 of an outer surface of the sleeve 8. That is, the axis line h1 and the axis line z1 are the same. The axis line z1 coincides with a center axis line of the definite-diameter circumferential surface 34. The axis line h1 is substantially equal to an axis line of the hosel hole 18. The axis line h1 of the shaft hole 30 is substantially equal to an axis line s1 of the shaft 6.

An angle θ1 between an axis line e1 of the hosel hole 18 and the axis line s1 of the shaft 6 is 0 degree (see FIG. 3). The angle θ1 is a maximum value of an angle between the axis line e1 and the axis line z1.

The shaft 6 is fixed to the shaft hole 30. The fixation is achieved by bond using a bonding agent. An outer surface of the shaft 6 is bonded to an inner surface of the shaft hole 30. The shaft 6 may be fixed to the shaft hole 30 by means other than bond.

The prevention of coming off of the sleeve 8 is achieved by screw combination. As shown in FIG. 3, the screw hole 32 of the sleeve 8 is connected to the screw 10 in a screwing manner. The screw connection prevents the coming off of the sleeve 8. An axial force caused by the screw connection is balanced with pressure between the hosel end surface 37 and the bump surface 39. In order to collateralize the axial force, a clearance K1 exists between a tip of the screw 10 and a bottom surface of the screw hole 32 in a state where the screw connection is completed (see FIG. 3). Thus, a coming-off preventing part is constituted by screw combination between the screw 10 and the screw hole 32.

As shown in FIGS. 4 and 5, the rotation-preventing part 38 of the sleeve 8 has twelve projection parts t2. The projection parts t2 are equally disposed in a circumferential direction. That is, the projection parts t2 are disposed at every 30 degrees.

The rotation-preventing part 38 has rotational symmetry with the axis line z1 as a rotational symmetric axis. The rotational symmetry implies that the shape of the rotation-preventing part 38 rotated by (360/W) degrees around the rotational symmetric axis coincides with that of the unrotated rotation-preventing part 38. W is an integer of equal to or greater than 2. The coincidence of the shape of the rotation-preventing part 38 rotated by (360/W) degrees around the rotational symmetric axis with that of the unrotated rotation-preventing part 38 is also referred to as "W-fold rotation symmetry". The rotation-preventing part 38 has twelve-fold rotation-symmetry with respect to the axis line z1.

Figure 8:
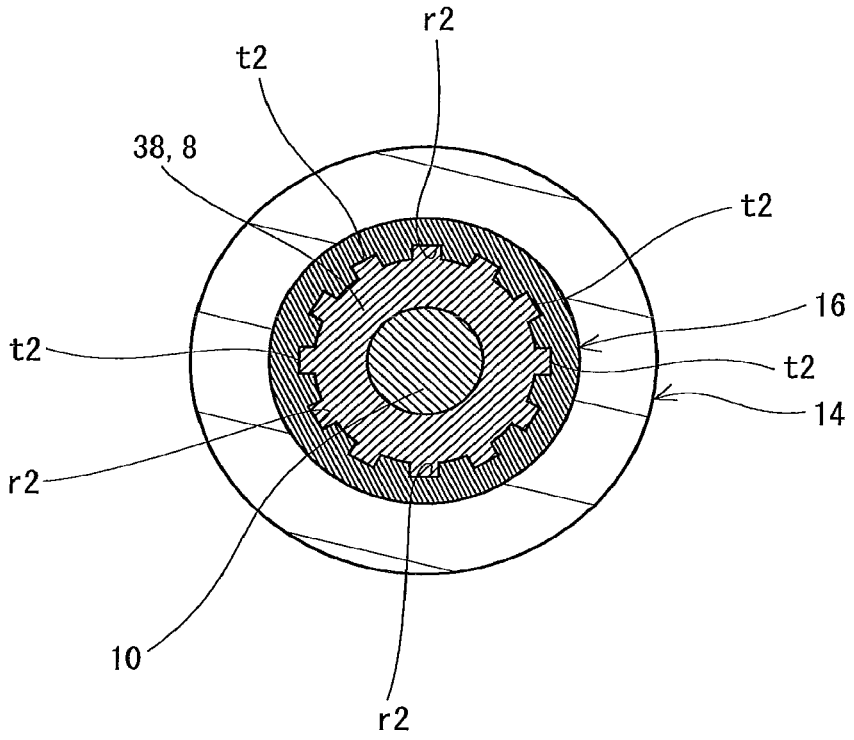
FIG. 8 is a sectional view taken along line F8-F8 of FIG. 3.

FIG. 8 is a sectional view taken along line F8-F8 of FIG. 3.

An outer surface of the engaging member 16 is a circumferential surface having a fixed outer diameter. On the other hand, a rotation-preventing part 48 is provided in the engaging member 16. The rotation-preventing part 48 is formed by twelve recess parts r2. The recess parts r2 are disposed at equal intervals in a circumferential direction. The engaging member 16 may be integrally formed as a part of the head body 14.

The rotation-preventing part 48 has rotational symmetry with the axis line z1 as a rotational symmetric axis. The rotation-preventing part 48 has twelve-fold rotation-symmetry with respect to the axis line z1. The shape of the rotation-preventing part 48 corresponds to the shape of the rotation-preventing part 38.

The engaging member 16 formed independently from the head body 14 can be formed with high dimensional accuracy. For example, the engaging member 16 formed independently from the head body 14 can be easily cut. Independent formation of the engaging member 16 from the head body 14 can contribute to improvement in dimensional accuracy of the rotation-preventing part 48 of the engaging member 16.

The engaging member 16 having an outer surface as a cylindrical surface tends to be formed with high dimensional accuracy. The engaging member 16 in which a center axis of an outer surface coincides with a center axis of an inner surface tends to be formed with high dimensional accuracy.

The regulation of relative rotation between the sleeve 8 and the hosel hole 18 is achieved by the engagement of the rotation-preventing part 38 and the rotation-preventing part 48. The rotation-preventing part 38 and the rotation-preventing part 48 are engaged with each other so that relative rotation of the head 4 and the shaft 6 is regulated.

The circumferential relative positions in which the rotation-preventing part 38 and the rotation-preventing part 48 can be engaged with each other are twelve kinds. In the embodiment, the angle θ1 is 0 degree. Thereby, when the circumferential relative positions are altered, a loft angle, a lie angle, and a hook angle are not changed. In the present application, the circumferential relative position is also referred to as a circumferential mounting position.

The number of the circumferential mounting positions is 12 in the embodiment. However, the number is not restricted to 12. As the number of the circumferential mounting positions, 4, 5, 6, and 8 or the like are exemplified. In respect of improving adjustment accuracy, the number of the circumferential mounting positions is preferably equal to or greater than 4, more preferably equal to or greater than 8, and still more preferably equal to or greater than 12. In respect of preventing the shape of the rotation-preventing part from being complicated, the number of the circumferential mounting positions is preferably equal to or less than 28, and more preferably equal to or less than 24.

When a shaft is removed from a head in the general golf club, a bonding agent bonding both the shaft and the head is destroyed by heating. However, in the golf club 2, the head body 14 and shaft 6 are detachably mounted to each other without destruction of the bonding agent.

In the embodiment, since the angle θ1 is 0 degree, the hook angle (face angle) of the club 2 is not changed even if the circumferential mounting position is altered. When the hook angle (face angle) is excessively changed, the direction of the face at address may seem to be excessively closed, or may seem to excessively opened. The direction of the face may make a golf player feel discomfort. The direction of the face may make the golf player feel difficulty of addressing.

In the present invention, the shaft 6 has anisotropy. In the present application, "anisotropy" implies a property producing coupled deformations of bending and torsion. A manufacturing method and a structure of a shaft having the anisotropy is disclosed in, for example, Japanese Patent Application Laid-Open No. 11-299944 or 2003-265661 described above. The shaft 6 of the present application can be also manufactured by the manufacturing methods described in these gazettes.

Figure 9:
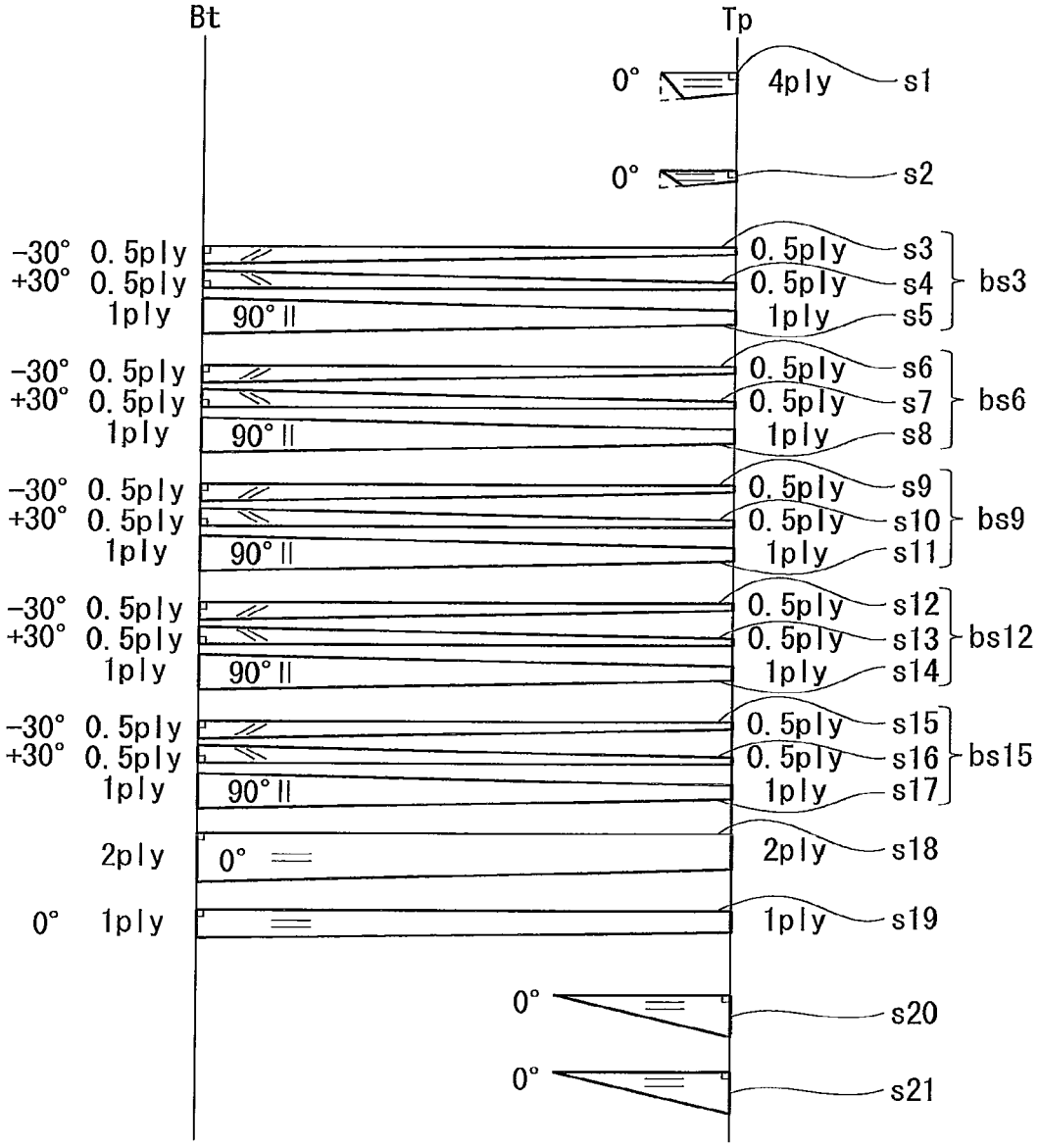
FIG. 9 is a developed view showing an example of a prepreg constitution of a shaft according to the present invention.

FIG. 9 is a developed view showing an example (a first laminate constitution) of a laminate constitution of the shaft 6.

The shaft 6 is manufactured by a so-called a sheet winding manufacturing method. In the manufacture of the shaft 6, first, a prepreg is cut to prepare prepreg sheets shown in FIG. 9. Angles described in FIG. 9 show orientation angles of fibers to a longitudinal direction of the shaft. In the embodiment of FIG. 9, 21 sheets are used.

Figure 10:
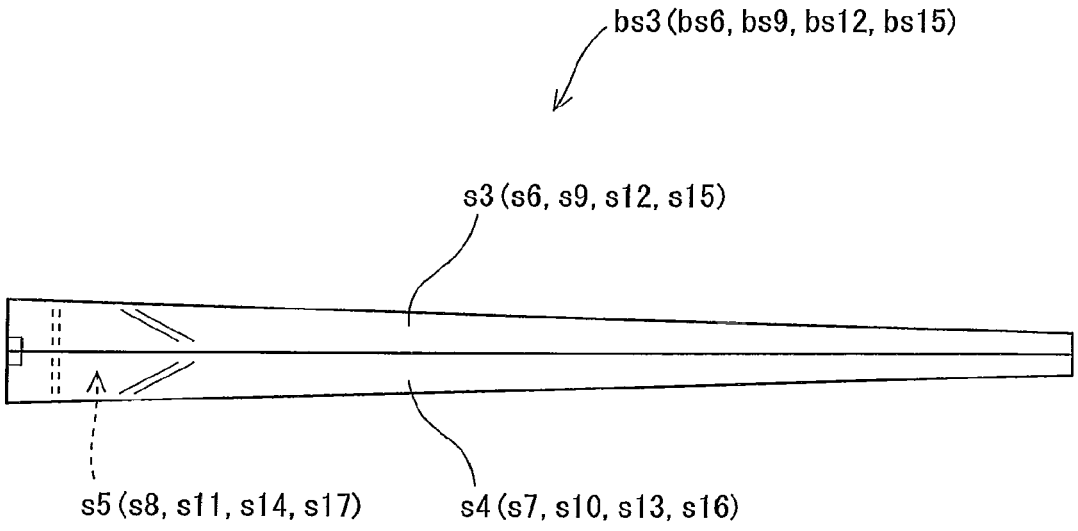
FIG. 10 is a view showing a state where an anisotropy-exhibiting sheet is laminated on a hoop layer sheet.

Next, a laminating step is conducted. FIG. 10 shows a united sheet obtained by the laminating step.

In the laminating step, a sheet s3 and a sheet s4 are laminated on a sheet s5 to obtain a united sheet bs3. Similarly, a sheet s6 and a sheet s7 are laminated on a sheet s8 to obtain a united sheet bs6. Similarly, a sheet s9 and a sheet s10 are laminated on a sheet s11 to obtain a united sheet bs9. Similarly, a sheet s12 and a sheet s13 are laminated on a sheet s14 to obtain a united sheet bs12. Similarly, a sheet s15 and a sheet s16 are laminated on a sheet s17 to obtain a united sheet bs15.

The bias sheet s3 is independently hard to wind. Similarly, the bias sheet s4 is independently hard to wind. These are laminated on the sheet s5 which is a hoop layer sheet to obtain the united sheet bs3. As shown in FIG. 10, the sheet s3 and the sheet s4 are laminated on the sheet s5 so that the sheets s3 and s4 are placed without gaps. A contour shape of the sheet s5 substantially coincides with a contour shape obtained by placing the sheet s3 and the sheet s4 without gaps. Orientation of a fiber of the sheet s3 and orientation of a fiber of the sheet s4 are reverse to each other. The united sheet bs3 is presented for a winding step.

The bias sheet s6 is independently hard to wind. Similarly, the bias sheet s7 is independently hard to wind. These are laminated on the sheet s8 which is a hoop layer sheet to obtain the united sheet bs6. As shown in FIG. 10, the sheet s6 and the sheet s7 are laminated on the sheet s8 so that the sheets s6 and s7 are placed without gaps. A contour shape of the sheet s8 substantially coincides with a contour shape obtained by placing the sheet s6 and the sheet s7 without gaps. Orientation of a fiber of the sheet s6 and orientation of a fiber of the sheet s7 are reverse to each other. The united sheet bs6 is presented for the winding step.

The bias sheet s9 is independently hard to wind. Similarly, the bias sheet s10 is independently hard to wind. These are laminated on the sheet s11 which is a hoop layer sheet to obtain the united sheet bs9. As shown in FIG. 10, the sheet s9 and the sheet s10 are laminated on the sheet s11 so that the sheets s9 and s10 are placed without gaps. A contour shape of the sheet s11 substantially coincides with a contour shape obtained by placing the sheet s9 and the sheet s10 without gaps. Orientation of a fiber of the sheet s9 and orientation of a fiber of the sheet s10 are reverse to each other. The united sheet bs9 is presented for the winding step.

The bias sheet s12 is independently hard to wind. Similarly, the bias sheet s13 is independently hard to wind. These are laminated on the sheet s14 which is a hoop layer sheet to obtain the united sheet bs12. As shown in FIG. 10, the sheet s12 and the sheet s13 are laminated on the sheet s14 so that the sheets s12 and s13 are placed without gaps. A contour shape of the sheet s14 substantially coincides with a contour shape obtained by placing the sheet s12 and the sheet s13 without gaps. Orientation of a fiber of the sheet s12 and orientation of a fiber of the sheet s13 are reverse to each other. The united sheet bs12 is presented for the winding step.

The bias sheet s15 is independently hard to wind. Similarly, the bias sheet s16 is independently hard to wind. These are laminated on the sheet s17 which is a hoop layer sheet to obtain the united sheet bs15. As shown in FIG. 10, the sheet s15 and the sheet s16 are laminated on the sheet s17 so that the sheets s15 and s16 are placed without gaps. A contour shape of the sheet s17 substantially coincides with a contour shape obtained by placing the sheet s15 and the sheet s16 without gaps. Orientation of a fiber of the sheet s15 and orientation of a fiber of the sheet s16 are reverse to each other. The united sheet bs15 is presented for the winding step.

The united sheet bs3, the united sheet bs6, the united sheet bs9, the united sheet bs12, and the united sheet bs15 are the same except for a difference in a slight dimension.

Next, the winding step is conducted. In the winding step, the sheets are wound around a mandrel in order shown in FIG. 9. The sheets are sequentially wound from the sheet described at the highest position in FIG. 9.

Next, a wrapping tape is wound. Next, a heating step is conducted. A heating furnace is used for the heating step. A matrix resin of the prepreg is cured by the heating step. Next, the wrapping tape is removed, and the mandrel is pulled out. Next, a tip part and a back-end part are cut. Next, surface polishing is conducted. Finally, coating is conducted.

In the winding step, the united sheet bs3, the united sheet bs6, the united sheet bs9, the united sheet bs12, and the united sheet bs15 are wound from the same circumferential position.

The number of windings of the sheet s3 is 0.5 ply. That is, a setting range in the circumferential direction of the sheet s3 is about 180 degrees. The number of windings of the sheet s4 is 0.5 ply. The number of windings of the sheet s6 is 0.5 ply. The number of windings of the sheet s7 is 0.5 ply. The number of windings of the sheet s9 is 0.5 ply. The number of windings of the sheet s10 is 0.5 ply. The number of windings of the sheet s12 is 0.5 ply. The number of windings of the sheet s13 is 0.5 ply. The number of windings of the sheet s15 is 0.5 ply. The number of windings of the sheet s16 is 0.5 ply. These are set to 0.5 ply in order to efficiently exhibit anisotropy.

The sheets of a first group consisting of the sheet s3, the sheet s6, the sheet s9, the sheet s12, and the sheet s15 in the sheet constitution of FIG. 9 are disposed in the same circumferential position. On the other hand, the sheets of a second group consisting of the sheet s4, the sheet s7, the sheet s10, the sheet s13, and the sheet s16 are disposed in the same circumferential position. In the sheets belonging to the first group, the orientations of the fibers are the same. In the sheets belonging to the second group, the orientations of the fibers are the same. The orientations of the fibers of the sheets belonging to the first group and the orientations of the fibers of the sheets belonging to the second group are reverse to each other. The sheets of the first group and the sheets of the second group are disposed at circumferential positions different from each other. If the sheets of the first group are disposed in the circumferential position of 0 to 180 degrees, the sheets of the second group are disposed in the circumferential position of 180 to 360 degrees. In the constitution, directions of inclination of bias layers are reverse to each other every other half round. The constitution contributes to efficient exhibition of anisotropy. The constitution contributes to increase in a bending torsional amount.

Figure 11:
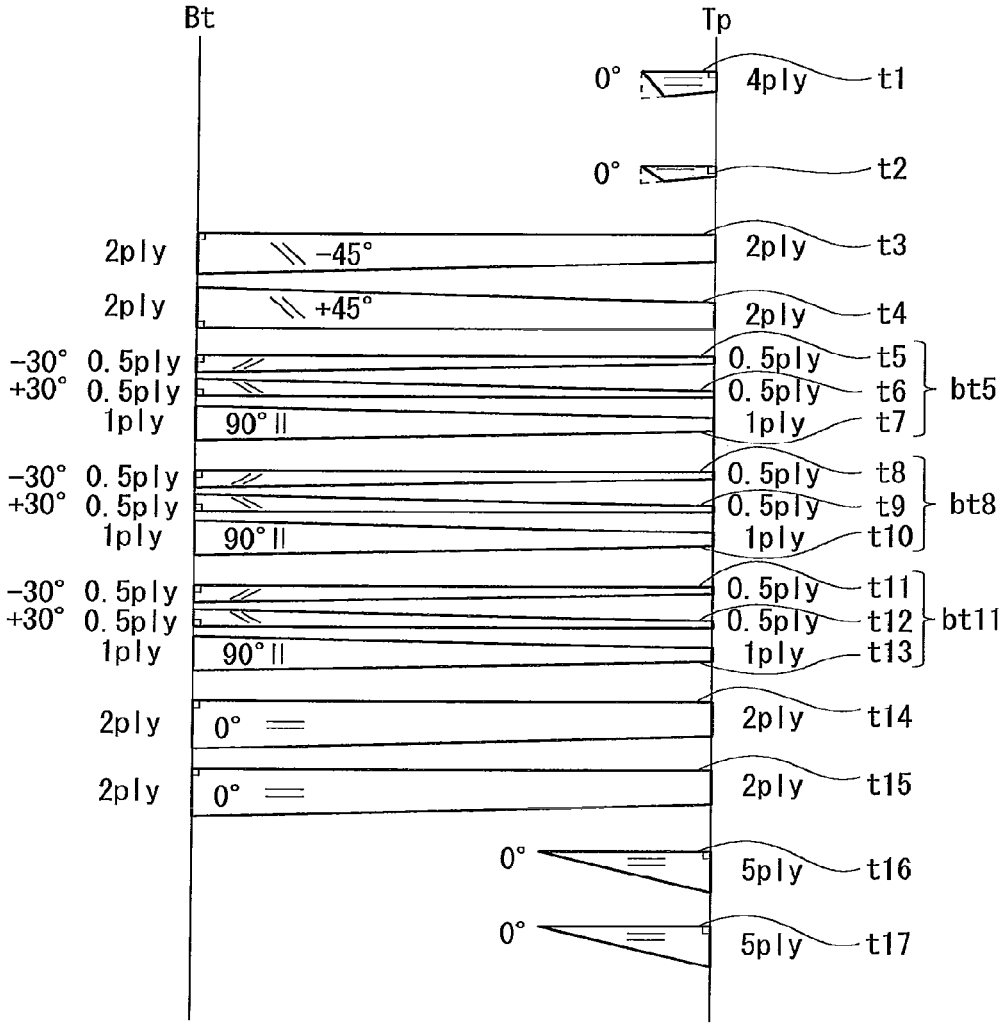
FIG. 11 is a developed view showing another example of the prepreg constitution of the shaft according to the present invention.

FIG. 11 is a developed view showing another example (a second laminate constitution) of the laminate constitution of the shaft 6. In the embodiment of FIG. 11, 17 sheets are used.

In the embodiment of FIG. 11, the number of the sheets (hereinafter, may be also referred to as an anisotropy-exhibiting sheet) exhibiting anisotropy is reduced as compared with the embodiment of FIG. 9.

Figure 12:
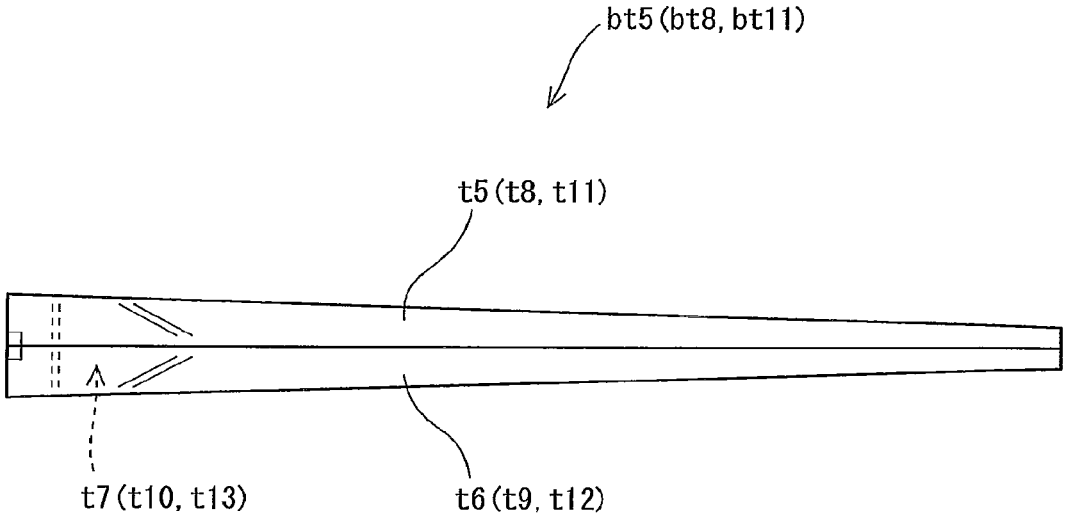
FIG. 12 is a view showing a state where an anisotropy-exhibiting sheet is laminated on a hoop layer sheet.

Also in the embodiment, an anisotropy-exhibiting sheet of 0.5 ply is used. Also in the embodiment, an anisotropy-exhibiting layer is wound in a state where the anisotropy-exhibiting layer is laminated on a hoop layer prepreg. FIG. 12 shows a united sheet obtained by a laminating step.

Also in the embodiment, after a step for cutting a prepreg, the laminating step is conducted. In the laminating step, a sheet t5 and a sheet t6 are laminated on a sheet t7 to obtain a united sheet bt5. Similarly, a sheet t8 and a sheet t9 are laminated on a sheet t10 to obtain a united sheet bt8. Similarly, a sheet t11 and a sheet t12 are laminated on a sheet t13 to obtain a united sheet bt11. These united sheets are presented for a winding step.

In the embodiment, bias sheets t3 and t4 are used together. These bias sheets are used also in the usual shaft, and do not exhibit anisotropy substantially. These bias sheets t3 and t4 improve torsional strength and torsional rigidity.

In the winding step, the sheets are wound around a mandrel in order shown in FIG. 11. The sheets are sequentially wound from the sheet described at the highest position in FIG. 11. In the winding step, the united sheet bt5, the united sheet bt8, and the united sheet bt11 are wound from the same circumferential position.

The disposal of the anisotropy-exhibiting sheet is the same as that of the first laminate constitution. A first group consisting of the sheet t5, the sheet t8, and the sheet t11 is disposed in the same circumferential position. A second group consisting of the sheet t6, the sheet t9, and the sheet t12 is disposed in the same circumferential position. The sheets of the first group and the sheets of the second group are disposed at circumferential positions different from each other. If the sheets of the first group are disposed in the circumferential position of 0 to 180 degrees, the sheets of the second group are disposed in the circumferential position of 180 to 360 degrees. In the constitution, directions of inclination of bias layers are reverse to each other every other half round. The constitution contributes to efficient exhibition of anisotropy. The constitution contributes to increase in a bending torsional amount.

In addition to the sheet constitution described above, for example, a sheet constitution described in the above-mentioned Japanese Patent Application Laid-Open No. 11-299944 or 2003-265661 can be also employed.

Figure 13:
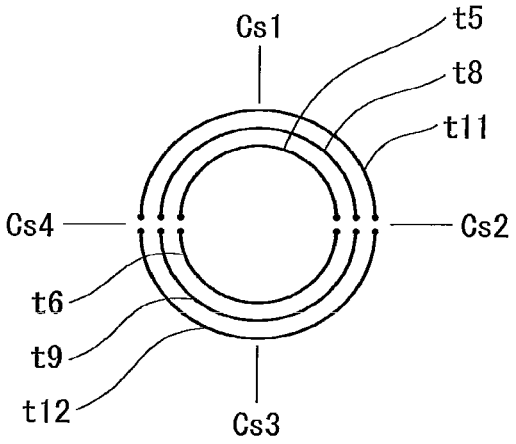
FIG. 13 is a conceptual view showing a circumferential disposal of the anisotropy-exhibiting sheet.

FIG. 13 is a conceptual view showing the disposal of the anisotropy-exhibiting sheets in the shaft having the sheet constitution of FIG. 11. In FIG. 13, the ends of the sheets are shown by circles. In the constitution, a first anisotropy-exhibiting sheet (sheet t5) is disposed at the circumferential position of 0 degree to 180 degrees, and a second anisotropy-exhibiting sheet (sheet t6) is disposed at the circumferential position of 180 degrees to 360 degrees. The orientations of the fibers are reverse to each other between the first anisotropy-exhibiting sheet (sheet t5) and the second anisotropy-exhibiting sheet (sheet t6). The constitution is set over the whole longitudinal direction of the shaft.

As shown in FIG. 13, the first anisotropy-exhibiting sheet includes a plurality of layers (three layers: the sheet t5, the sheet t8, the sheet t11); and the second anisotropy-exhibiting sheet also includes a plurality of layers (three layers: the sheet t6, the sheet t9, the sheet t12). The anisotropy-exhibiting sheet is constituted by the plurality of layers, thereby increasing a bending torsional amount.

Figure 14:
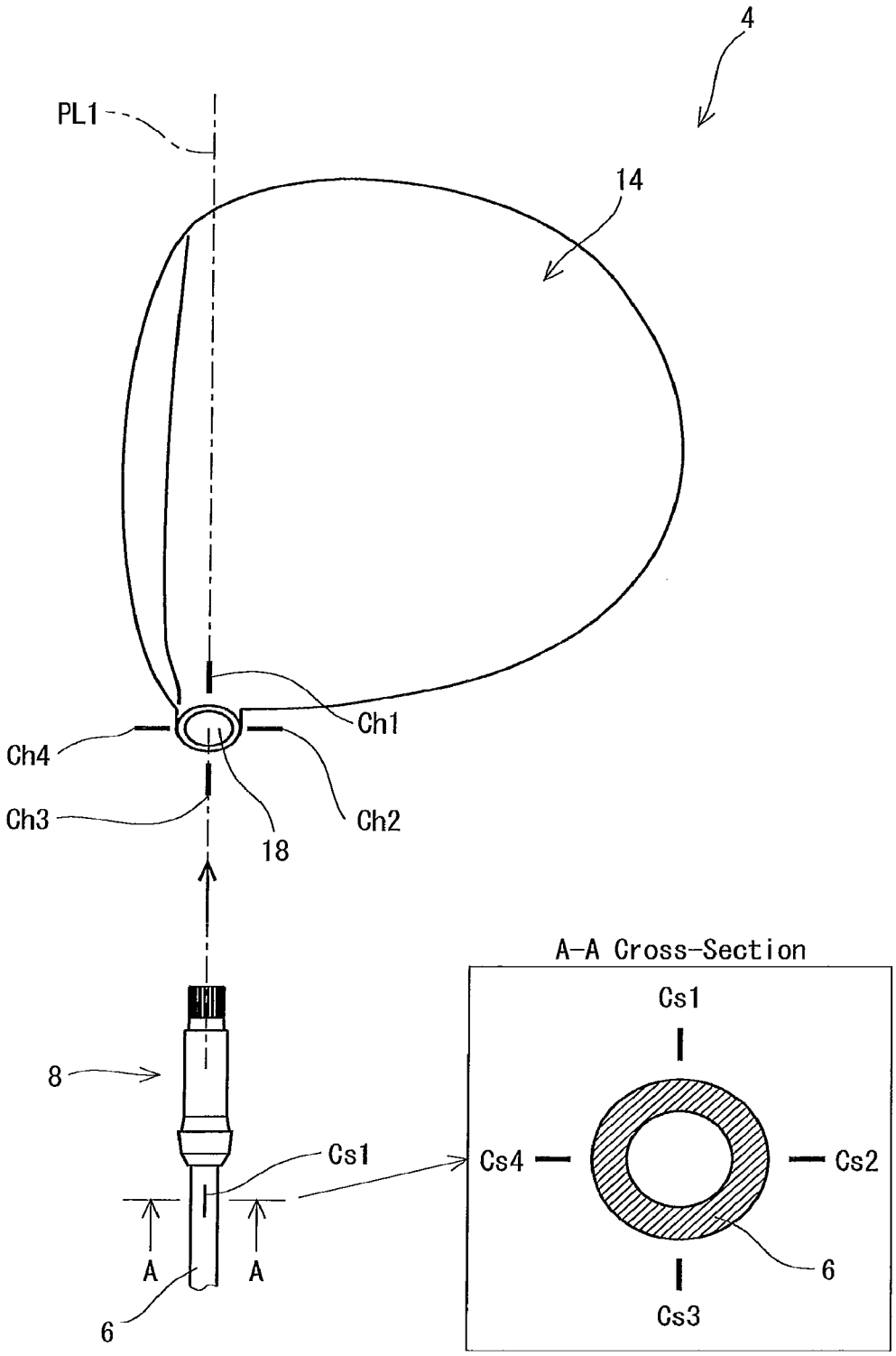
FIG. 14 is a view for describing a circumferential reference position of a head.

FIG. 14 is a view for describing the relationship between a head 4 and a shaft 6. Herein, in respect of facilitating the following description, a circumferential reference position Ch1 of the head 4 is defined. When the head 4 is grounded on a level surface sh1 along a real loft angle and a lie angle thereof, a plane PL1 including an axis line of a hosel hole and being perpendicular to the level surface sh1 is considered. The number of lines of intersection of the plane PL1 and an inner surface of a hosel hole 18 is two. A position of the line of intersection placed on a toe side, of the two lines of intersection is defined as the circumferential reference position Ch1 (see FIG. 14). When the hosel hole 18 is viewed from above (grip side), a position rotated clockwise by 90 degrees from the circumferential reference position Ch1 is a circumferential position Ch2 (see FIG. 14). When the hosel hole 18 is viewed from above (grip side), a position rotated clockwise by 180 degrees from the circumferential reference position Ch1 is a circumferential position Ch3. When the hosel hole 18 is viewed from above (grip side), a position rotated clockwise by 270 degrees from the circumferential reference position Ch1 is a circumferential position Ch4. Hereinafter, description will be given using these circumferential positions ch1, 2, 3, and 4.

A relative positional relationship between an anisotropic shaft and the head in the circumferential direction is important. The relative positional relationship, that is, a circumferential mounting position affects a correcting function of hook and slice.

[Bending Torsional Amount]

Figure 15:
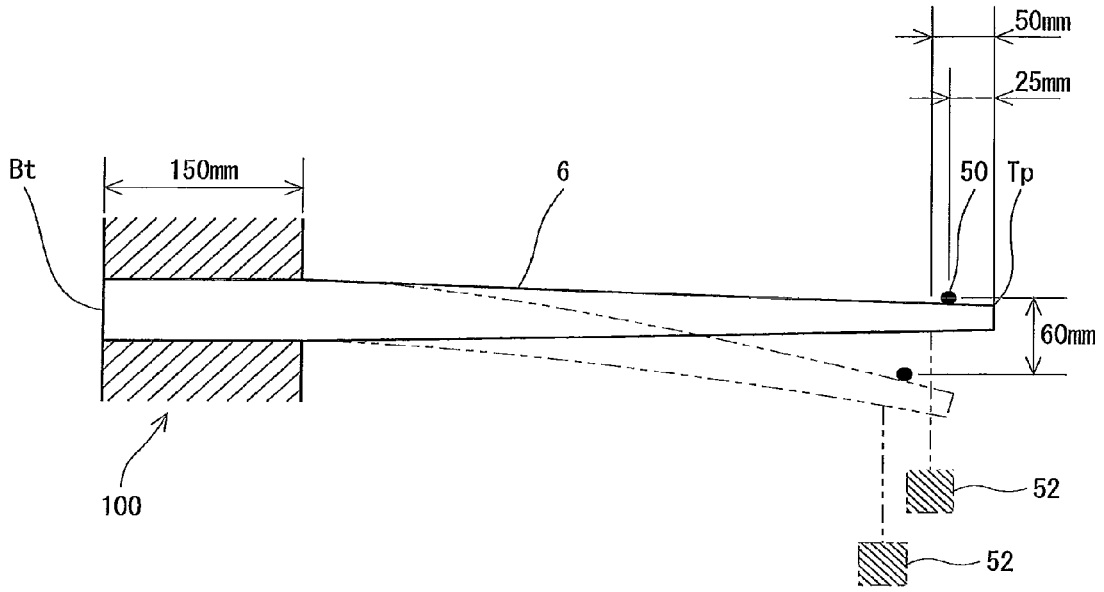
FIG. 15 is a view for describing a measuring method of a bending torsional amount.
Figure 16:
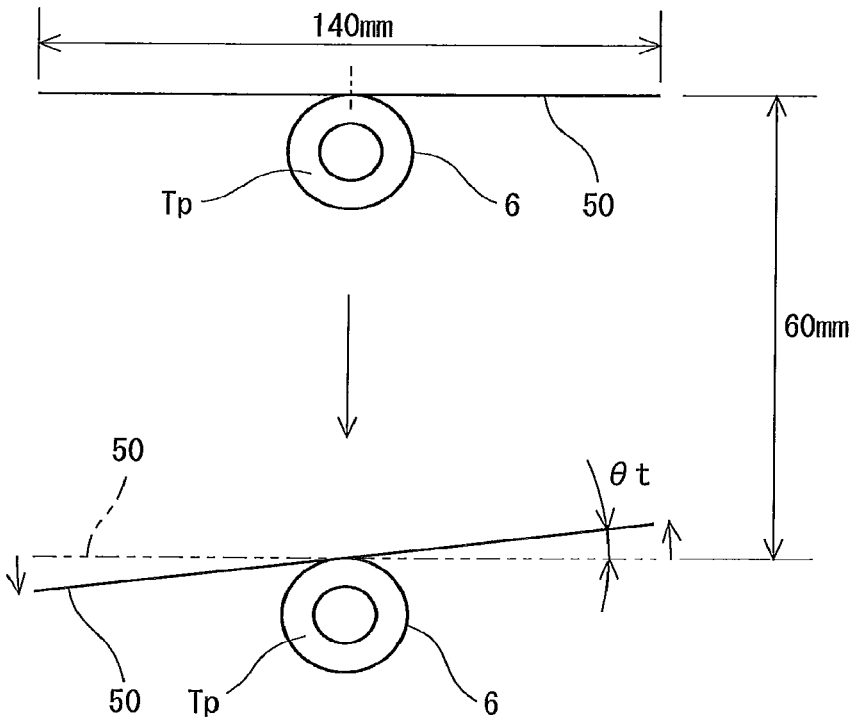
FIG. 16 is a view for describing the measuring method of the bending torsional amount.

The anisotropic shaft shows coupled deformations of bending and torsion. The property is quantitatively evaluated by the "bending torsional amount". FIGS. 15 and 16 are views for describing a measuring method of the bending torsional amount. FIG. 15 is a side view showing a situation of measurement. FIG. 16 is a front view of the shaft 6, as viewed from a tip Tp side of the shaft 6. FIG. 16 shows a state before a weight 52 is hung, on the upper side. FIG. 16 shows a state after the weight 52 is hung, on the lower side.

In measurement of the bending torsional amount, a jig 100 fixing a back-end part of the shaft, a straight stick 50, and the weight 52 are prepared.

In the measurement of the bending torsional amount, a back-end part of the shaft 6 is first fixed. A range between a back end Bt of the shaft and a position separated by 150 mm from the back end Bt is fixed (see FIG. 15). Next, the stick 50 is fixed to a specific position in the circumferential direction of the shaft 6. The stick 50 is fixed to the most upper side in the circumferential direction of the shaft 6 (see FIG. 16). The fixation is conducted by, for example, an adhesive. The stick 50 is leveled in the state before the weight 52 is hung (see FIG. 16). The stick 50 is fixed to a point separated by 25 mm from the tip Tp of the shaft (see FIG. 15).

Next, the weight 52 is hung. A weight of the weight 52 is adjusted so that a bending amount is set to 60 mm. The bending amount is a moving distance in the vertical direction of the stick 50 (see FIGS. 15 and 16). A position (load point) of the weight 52 is a point separated by 50 mm from the tip Tp of the shaft (see FIG. 15). The shaft 6 is deflected by the load of the weight 52. The shaft 6 is stopped at a constant position in a state where the shaft 6 is deflected. In the state, an inclination angle θt of the stick 50 is read off (see FIG. 16). The maximum value of the inclination angle θt is the bending torsional amount. In respect of accuracy of reading off, it is preferable that the stick 50 is comparatively longer. For example, the length of the stick 50 is set to 140 mm (see FIG. 16).

The bending torsional amount is determined by considering a torsional direction. In the measurement of FIG. 15, when the shaft 6 is viewed from the grip side (the back end Bt side of the shaft), the shaft 6 is twisted clockwise or unticlockwise by a bending caused by the weight 52. When the shaft 6 is viewed from the grip side (the back end Bt side of the shaft), a torsional angle θt is defined as plus in a case where the shaft 6 is twisted unticlockwise by a bending caused by the weight 52. To the contrary, when the shaft 6 is viewed from the grip side (the back end Bt side of the shaft), the torsional angle θt is defined as minus in a case where the shaft 6 is twisted clockwise by the bending caused by the weight 52. Since the shaft 6 is viewed from the head side in FIG. 16, FIG. 16 shows a case where the torsional angle θt is minus. The maximum value of the torsional angle θt is the bending torsional amount.

In respect of facilitating the description, a circumferential position of the shaft 6 as shown in FIG. 13 is defined. A circumferential reference position Cs1 of the shaft is a circumferential position at which the torsional angle θt is maximized when a weight is hung with the circumferential reference position set right above. When the torsional angle θt is measured in a state where a circumferential position Cs3 separated by 180 degrees in the circumferential direction from the circumferential reference position Cs1 of the shaft is set right above, the torsional angle θt is minimized (minus value). When the torsional angle θt is measured in a state where a circumferential position Cs2 separated by 90 degrees in the circumferential direction from the circumferential reference position Cs1 of the shaft is set right above, the torsional angle θt is zero. When the torsional angle θt is measured in a state where a circumferential position Cs4 separated by 270 degrees in the circumferential direction from the circumferential reference position Cs1 of the shaft is set right above, the torsional angle θt is zero.

Figure 17:
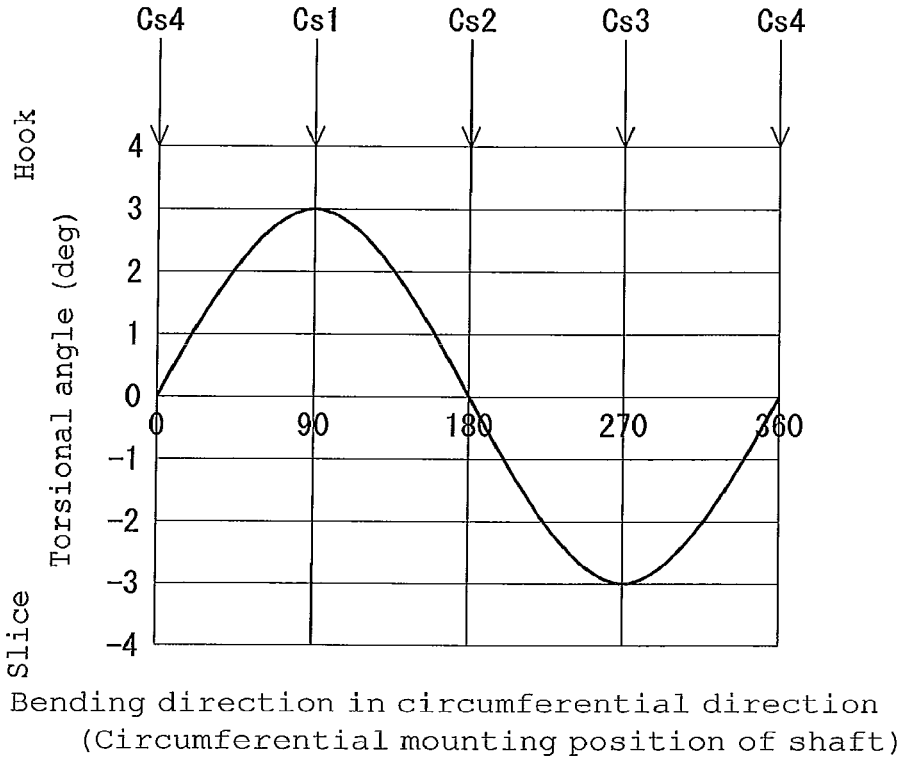
FIG. 17 is a graph showing the relationship between a bending direction and a torsional angle.

The torsional angle θt is changed according to a direction where the shaft is bent. FIG. 17 is a graph showing the relationship between the direction where the shaft is bent and the torsional angle θt. In the graph, the circumferential reference position Cs1 of the shaft is set to "90 degrees". As shown in the graph, when the shaft is bent downward in a state where the circumferential reference position Cs1 of the shaft is set right above, the torsional angle θt is maximized. The maximum value is the bending torsional amount.

In respect of improving an effect of correcting the direction of the face, the bending torsional amount is preferably equal to or greater than 0.5 degree, more preferably equal to or greater than 1.0 degree, still more preferably equal to or greater than 1.5 degrees, and yet still more preferably equal to or greater than 2.0 degrees. In respect of preventing the adjustment interval of the correction from being excessive, the bending torsional amount is preferably equal to or less than 5.0 degrees, and more preferably equal to or less than 4.0 degrees.

A circumferential relative position between the shaft 6 and the head 4, that is, a circumferential mounting position can be determined in consideration of bending of the shaft in impact. The circumferential relative position between the shaft 6 and the head 4 is determined so that the bending of the shaft in impact causes the intended torsion of the shaft.

FIG. 14 shows a case where the circumferential reference position Cs1 of the shaft is coincided with the circumferential reference position Ch1 of the head. In the case, torsion, which linked with the bending of the shaft 6 accompanying a so-called toe-down phenomenon, to close the face is generated.

In the golf club using the shaft 6, the direction of the face in impact can be adjusted due to the torsion of the shaft 6. In the golf club using the shaft 6, the adjustment effect of a hitting direction can be obtained while an inclination angle θ1 of a shaft hole 42 can be suppressed. The shaft 6 is twisted due to the bending of the shaft in impact to correct the direction of the face.

In the same golf player, a track (trajectory) may be different depending on the day when the golf player plays. For example, in a certain golf player X, a case where the degree of slice is great, and a case where the degree of the slice is small may exist. In such a case, the degree of the correcting effect of the slice caused by anisotropy can be adjusted by altering the circumferential mounting position of the shaft (position).

For example, a certain golf player Y may slice or hook a ball depending on the condition of the day. In such a case, in the day when the golf player Y is apt to slice the ball, the golf player Y can employ a position closing a head in impact. In the day when the golf player Y is apt to hook the ball, the golf player Y can employ a position opening the head in impact. Thus, the golf player Y can use a torsional effect caused by anisotropy to correct both the slice and the hook using one golf club.

Bending caused by a so-called toe-down phenomenon is considered as the bending of the shaft in impact. However, other bending is also considered. The bending in impact may be different depending on the golf player. The golf player can conduct a trial hit at some positions. The golf player can find a position suitable for the golf player based on the result of the trial hit.

A material of the head body 14 is not restricted. As the preferable material, a metal, carbon fiber reinforced plastic (CFRP), and a combination thereof are exemplified. More preferably, the material is the metal. As the metal, a titanium alloy, stainless steel, an aluminum alloy, a magnesium alloy, and a combination thereof are exemplified. A manufacturing method of each of the members constituting the head body 14 is not restricted. As the manufacturing method, forging, casting, pressing, and a combination thereof are exemplified. The head body 14 may be formed by joining a plurality of members.

A material of the shaft 6 is not restricted. As the material of the shaft, carbon fiber reinforced plastic (CFRP) and a metal are exemplified. A so-called carbon shaft and steel shaft can be suitably used. A structure of the shaft is not restricted.

A material of the sleeve 8 is not restricted. As the preferable material, a titanium alloy, stainless steel, an aluminum alloy, a magnesium alloy, and a resin are exemplified. In respects of strength and of lightweight, for example, the aluminum alloy and the titanium alloy are more suitable. It is preferable that the resin has excellent mechanical strength. For example, the resin is preferably a resin referred to as an engineering plastic or a super-engineering plastic.

A material of the engaging member 16 is not restricted. As the preferable material, a titanium alloy, stainless steel, an aluminum alloy, a magnesium alloy, and a resin are exemplified. It is preferable that the resin has excellent mechanical strength. For example, the resin is preferably a resin referred to as an engineering plastic or a super-engineering plastic. As described above, the engaging member 16 may be integrally formed with the head body. More preferably, in respect of ensuring the fixation of the engaging member 16, the engaging member 16 is preferably made of a material capable of being welded to the head body 14.

A material of the screw 10 is not restricted. As the preferable material, a titanium alloy, stainless steel, an aluminum alloy, and a magnesium alloy or the like are exemplified.

A prepreg capable of being used as a material of the shaft is not restricted. The following Table 1 shows examples of prepregs capable of being used. In respects of a bending torsional amount and of strength of the shaft, a prepreg in which a tensile elastic modulus of a fiber is 40 (t/mm$^2$) is particularly preferable for the anisotropy-exhibiting sheet.

TABLE 1

Examples of prepregs capable of being used

| Manufacturer | Item number of prepreg sheet | Thickness of sheet (mm) | Fiber content (% by weight) | Resin content (% by weight) | Property value of carbon fiber: Item number of carbon fiber | Tensile modulus (t/mm$^2$) | Tensile strength (kgf/mm$^2$) |
|---|---|---|---|---|---|---|---|
| Toray Industries, Inc. | 3255S-10 | 0.082 | 76 | 24 | T700S | 23.5 | 500 |
| Toray Industries, Inc. | 3255S-12 | 0.103 | 76 | 24 | T700S | 23.5 | 500 |
| Toray Industries, Inc. | 3255S-15 | 0.123 | 76 | 24 | T700S | 23.5 | 500 |
| Toray Industries, Inc. | 805S-3 | 0.034 | 60 | 40 | M30S | 30 | 560 |
| Toray Industries, Inc. | 2255S-10 | 0.082 | 76 | 24 | T800S | 30 | 600 |
| Toray Industries, Inc. | 2255S-12 | 0.102 | 76 | 24 | T800S | 30 | 600 |
| Toray Industries, Inc. | 2255S-15 | 0.123 | 76 | 24 | T800S | 30 | 600 |
| Toray Industries, Inc. | 2256S-10 | 0.077 | 80 | 20 | T800S | 30 | 600 |
| MITSUBISHI RAYON CO., LTD. | TR350C-100S | 0.083 | 75 | 25 | TR50S | 24 | 500 |
| MITSUBISHI RAYON CO., LTD. | TR350C-125S | 0.104 | 75 | 25 | TR50S | 24 | 500 |
| MITSUBISHI RAYON CO., LTD. | TR350C-150S | 0.124 | 75 | 25 | TR50S | 24 | 500 |
| MITSUBISHI RAYON CO., LTD. | MR350C-075S | 0.063 | 75 | 25 | MR40 | 30 | 450 |
| MITSUBISHI RAYON CO., LTD. | MR350C-100S | 0.085 | 75 | 25 | MR40 | 30 | 450 |
| MITSUBISHI RAYON CO., LTD. | MR350C-125S | 0.105 | 75 | 25 | MR40 | 30 | 450 |
| MITSUBISHI RAYON CO., LTD. | MR350E-100S | 0.093 | 70 | 30 | MR40 | 30 | 450 |
| MITSUBISHI RAYON CO., LTD. | HRX350C-075S | 0.057 | 75 | 25 | HR40 | 40 | 450 |
| MITSUBISHI RAYON CO., LTD. | HRX350C-110S | 0.082 | 75 | 25 | HR40 | 40 | 450 |

Tensile strength and tensile modulus are values measured in conformity to JIS R 7601: 1986 "Testing method for carbon fiber".

EXAMPLES

Hereinafter, the effects of the present invention will be clarified by examples. However, the present invention should not be interpreted in a limited way based on the description of the examples.

[Production of Shaft]

Shafts according to examples 1, 2, and 3 and comparative example were produced as follows.

Example 1

There were used 16 sheets except a sheet t2, of 17 sheets shown in FIG. 11. A shaft having the laminate constitution was produced. The shaft having a bending torsional amount of 1.0 degree was obtained. The bending torsional amount was adjusted based on the thickness of an anisotropy-exhibiting sheet, the weight per unit area of fibers of the anisotropy-exhibiting sheet, the thickness of a bias layer sheet, and the weight per unit area of fibers of the bias layer sheet. The bias layer sheets are a sheet t3 and a sheet t4.

A prepreg having carbon fiber item number of "TR 50S" and manufactured by MITSUBISHI RAYON CO., LTD. was used for a straight layer sheet. The straight layer sheets are a sheet t1, a sheet t14, a sheet t15, a sheet t16, and a sheet t17.

A prepreg having carbon fiber item number of "MR40" and manufactured by MITSUBISHI RAYON CO., LTD. was used for an anisotropy-exhibiting sheet. As a hoop layer sheet, "805S-3" (trade name) manufactured by Toray Industries, Inc. was used. The entire length of the shaft was 1143 mm.

The number of plies (ply number) of each of the sheets in the example 1 is shown in FIG. 11. The number of plies in a butt Bt is shown on the left side of the sheet. The number of plies in a tip Tp is shown on the right side of the sheet.

Example 2

A shaft according to example 2 was obtained in the same manner as in the example 1 except that the number of plies of a bias layer sheet, the number of anisotropy-exhibiting sheets (0.5 ply), the fiber elastic modulus of the anisotropy-exhibiting sheet, the thickness of the anisotropy-exhibiting sheet and/or the weight per unit area of fibers of the anisotropy-exhibiting sheet were adjusted to set a bending torsional amount to 2.5 degrees.

Example 3

There were used 20 sheets except a sheet s2, of 21 sheets shown in FIG. 9. A shaft having the laminate constitution was produced. The shaft having a bending torsional amount of 4.5 degrees was obtained. The bending torsional amount was adjusted based on the thickness of an anisotropy-exhibiting sheet, and the weight per unit area of fibers of the anisotropy-exhibiting sheet.

A prepreg having carbon fiber item number of "TR 50S" and manufactured by MITSUBISHI RAYON CO., LTD. was used for a straight layer sheet. The straight layer sheets are a sheet s1, a sheet s18, a sheet s19, a sheet s20, and a sheet s21.

A prepreg having carbon fiber item number of "MR40" and manufactured by MITSUBISHI RAYON CO., LTD. was used for an anisotropy-exhibiting sheet. As a hoop layer sheet, "805S-3" (trade name) manufactured by Toray Industries, Inc. was used. The entire length of the shaft was 1143 mm.

The number of plies (ply number) of each of the sheets in the example 3 is shown in FIG. 9. The number of plies in a butt Bt is shown on the left side of the sheet. The number of plies in a tip Tp is shown on the right side of the sheet.

Comparative Example

There was altered the circumferential disposal of the anisotropy-exhibiting sheet used in the shaft of the example 1. A shaft generating no anisotropy was obtained by the disposal alteration. In the shaft, bias layers of 0.5 ply inclined in the same direction were disposed at a circumferential position of 0 to 180 degrees and a circumferential position of 180 to 360 degrees. In the disposal, the anisotropy was canceled by the bias layers of 0.5 ply to obtain a shaft having no anisotropy.

[Shaft-Sleeve Assemblies According to Examples]

The same sleeve as the sleeve 8 described above was prepared. In the sleeve, the angle θ1 was set to 0 degree. The sleeve was bonded to each of the tip parts of the shafts of the examples 1 to 3. A grip was mounted to the back-end part of the shaft to obtain a shaft-sleeve assembly. The length of the shaft-sleeve assembly was set so that a club length was 45.5 inches.

[Shaft-Sleeve Assembly According to Comparative Example]

There was used a sleeve of which the angle θ1 is 1.5 degrees. The sleeve was bonded to the tip part of the shaft of comparative example. A grip was mounted to the back-end part of the shaft to obtain a shaft-sleeve assembly. The length of the shaft-sleeve assembly was set so that a club length was 45.5 inches.

[Production of Head]

An engaging member and a head body were welded to obtain a head shown in FIGS. 1 and 3. The head was a head of a so-called driver (W#1). The volume of the head was 460 cc. The engaging member was disposed at a predetermined position. The engaging member was welded to the head body. Laser welding was used as a welding method. A welding part was irradiated with laser for welding so that the laser reaches to the welding part through a hosel hole. The same head was used in all the examples and the comparative example.

Positions of Examples

The shafts of the examples 1 to 3 have anisotropy. In these shafts, seven kinds of positions were set as a circumferential relative position (position) between the head and the shaft. These seven kinds of positions are as follows. These positions are shown in the following Tables 2 to 6.

(N1): A position obtained by rotating a circumferential reference position Cs1 of the shaft clockwise by 90 degrees with respect to a circumferential reference position Ch1 of the head, as viewed from a grip side. That is, the position obtained by coinciding the circumferential reference position Cs1 of the shaft with the circumferential reference position Ch2 of the head.

(F1): A position obtained by rotating the circumferential reference position Cs1 of the shaft clockwise by 60 degrees with respect to the circumferential reference position Ch1 of the head, as viewed from the grip side.

(F2): A position obtained by rotating the circumferential reference position Cs1 of the shaft clockwise by 30 degrees with respect to the circumferential reference position Ch1 of the head, as viewed from the grip side.

(F3): A position obtained by coinciding the circumferential reference position Cs1 of the shaft with the circumferential reference position Ch1 of the head (see FIG. 14).

(S1): A position obtained by rotating the circumferential reference position Cs1 of the shaft clockwise by 120 degrees with respect to the circumferential reference position Ch1 of the head, as viewed from the grip side.

(S2): A position obtained by rotating the circumferential reference position Cs1 of the shaft clockwise by 150 degrees with respect to the circumferential reference position Ch1 of the head, as viewed from the grip side.

(S3): A position obtained by rotating the circumferential reference position Cs1 of the shaft clockwise by 180 degrees with respect to the circumferential reference position Ch1 of the head, as viewed from the grip side. That is, the position obtained by coinciding the circumferential reference position Cs1 of the shaft with the circumferential reference position Ch3 of the head.

Position of Comparative Example

The shaft of the comparative example has no anisotropy. However, since the angle θ1 of the sleeve in the golf club of the comparative example is 1.5 degrees, a hook angle is changed depending on the position. The following seven kinds of positions were set. These positions are shown in the following Tables 2 to 6.

(NU): A position at which a lie angle is maximized.

(Fa): A position obtained by rotating a shaft of the position (NU) unticlockwise by 30 degrees, as viewed from a grip side.

(Fb): A position obtained by rotating the shaft of the position (NU) unticlockwise by 60 degrees, as viewed from the grip side.

(Fc): A position at which a hook angle is maximized. That is, a position obtained by rotating the shaft of the position (NU) unticlockwise by 90 degrees, as viewed from the grip side.

(Sa): A position obtained by rotating the shaft of the position (NU) clockwise by 30 degrees, as viewed from the grip side.

(Sb): A position obtained by rotating the shaft of the position (NU) clockwise by 60 degrees, as viewed from the grip side.

(Sc): A position at which the hook angle is minimized. That is, a position obtained by rotating the shaft of the position (NU) clockwise by 90 degrees, as viewed from the grip side.

Five testers (testers A to E) actually hit a golf ball, and evaluated these golf clubs. All the five testers are right-handed golf players. Characteristics of the testers are as follows.

[Tester A]: A golf player hitting a slice ball and addressing in a state where the golf player grounds a sole.

[Tester B]: A golf player hitting a slice ball and addressing in a state where the golf player grounds a sole.

[Tester C]: A golf player hitting a hook ball and addressing in a state where the golf player grounds a sole.

[Tester D]: A golf player hitting a hook ball and addressing in a state where the golf player grounds a sole.

[Tester E]: A golf player hitting a slice ball and addressing in a state where the golf player brings a direction of a face to a target without grounding a sole.

The tester A, the tester B, the tester C, and the tester D address in a state where the testers ground the sole. Therefore, these testers A to D tend to address to meet the hook angle (face angle). On the other hand, the tester E addresses in the state where the tester E brings the direction of the face to the target without grounding the sole. The tester E addresses with being hardly affected by the hook angle (face angle).

The tester A, the tester B, and the tester E are so-called slicers, and are apt to slice a ball. The tester C and the tester D are so-called hookers, and are apt to hook a ball.

[Evaluation]

The position according to characteristic of each of the testers was employed, and the correcting effect of slice or hook was evaluated. The correcting effect was confirmed by the attainment point of a ball. If "horizontal deviation" of the attainment point of the ball is on the left side, it means the slice is corrected. If "horizontal deviation" of the attainment point of the ball is on the right side, it means the hook is corrected. Simultaneously, "ease to address" and "horizontal directionality" were evaluated as sensory evaluation. The evaluation is conducted in five stages of 1 to 5. The more the score is, the higher the evaluation is.

[Tester A]

The tester A being apt to slice a ball evaluated the correcting effect of slice. In the examples 1 to 3, evaluation was conducted at positions N1, F1, F2, and F3. In the comparative example, evaluation was conducted at positions NU, Fa, Fb, and Fc. Evaluation results are shown in the following Table 2.

[Tester B]

The tester B being apt to slice a ball evaluated the correcting effect of slice. In the examples 1 to 3, evaluation was conducted at positions N1, F1, F2, and F3. In the comparative example, evaluation was conducted at positions NU, Fa, Fb, and Fc. Evaluation results are shown in the following Table 3.

[Tester C]

The tester C being apt to hook a ball evaluated the correcting effect of hook. In the examples 1 to 3, evaluation was conducted at positions N1, S1, S2, and S3. In the comparative example, evaluation was conducted at positions NU, Sa, Sb, and Sc. Evaluation results are shown in the following Table 4.

[Tester D]

The tester D being apt to hook a ball evaluated the correcting effect of hook. In the examples 1 to 3, evaluation was conducted at positions N1, S1, S2, and S3. In the comparative example, evaluation was conducted at positions NU, Sa, Sb, and Sc. Evaluation results are shown in the following Table 5.

[Tester E]

The tester E being apt to slice a ball evaluated the correcting effect of slice. In the examples 1 to 3, evaluation was conducted at positions N1, F1, F2, and F3. In the comparative example, evaluation was conducted at positions NU, Fa, Fb, and Fc. Evaluation results are shown in the following Table 6.

TABLE 2

| Results of tester A | | | | | | | | | | | | | | | | | | | |
|---|---|---|---|---|---|---|---|---|---|---|---|---|---|---|---|---|---|---|---|
| | | | Comparative Example | | | | Example 1 | | | | Example 2 | | | | Example 3 | | | |
| | | | Neutral | Hook 1 | Hook 2 | Hook 3 | Neutral | Hook 1 | Hook 2 | Hook 3 | Neutral | Hook 1 | Hook 2 | Hook 3 | Neutral | Hook 1 | Hook 2 | Hook 3 |
| | Position | | NU | Fa | Fb | Fc | N1 | F1 | F2 | F3 | N1 | F1 | F2 | F3 | N1 | F1 | F2 | F3 |
| Head | Loft angle | deg | 11 | 11.9 | 12.6 | 12.8 | 11 | 11 | 11 | 11 | 11 | 11 | 11 | 11 | 11 | 11 | 11 | 11 |
| | Lie angle | deg | 59 | 58.8 | 58.2 | 57.5 | 59 | 59 | 59 | 59 | 59 | 59 | 59 | 59 | 59 | 59 | 59 | 59 |
| | Hook angle | deg | 1 | 2.5 | 3.4 | 3.9 | 1 | 1 | 1 | 1 | 1 | 1 | 1 | 1 | 1 | 1 | 1 | 1 |
| Shaft | Bending torsional amount | deg | 0 | 0 | 0 | 0 | 1.0 | 1.0 | 1.0 | 1.0 | 2.5 | 2.5 | 2.5 | 2.5 | 4.5 | 4.5 | 4.5 | 4.5 |
| | Inclination of shaft axis | deg | 1.5 | 1.5 | 1.5 | 1.5 | 0 | 0 | 0 | 0 | 0 | 0 | 0 | 0 | 0 | 0 | 0 | 0 |
| Attainment point of ball | Distance | yard | 196 | 198 | 199 | 196 | 198 | 199 | 201 | 203 | 197 | 199 | 204 | 206 | 194 | 204 | 200 | 197 |

TABLE 2-continued

| Results of tester A | | | | | | | | | | | | | | | | | | |
|---|---|---|---|---|---|---|---|---|---|---|---|---|---|---|---|---|---|---|
| | | | Comparative Example | | | | Example 1 | | | | Example 2 | | | | Example 3 | | | |
| | | | Neut-ral | Hook 1 | Hook 2 | Hook 3 | Neu-tral | Hook 1 | Hook 2 | Hook 3 | Neu-tral | Hook 1 | Hook 2 | Hook 3 | Neu-tral | Hook 1 | Hook 2 | Hook 3 |
| | Horizontal deviation | yard | Right 16 | Right 7 | Left 5 | Left 7 | Right 19 | Right 15 | Right 12 | Right 10 | Right 18 | Right 11 | Right 2 | Left 3 | Right 20 | Right 5 9 | Left 14 | Left |
| Sensory evaluation | Ease to address | Five score scale | 5 | 2 | 1 | 1 | 5 | 5 | 5 | 5 | 5 | 5 | 5 | 5 | 5 | 5 | 5 | 5 |
| | Horizontal direction-ality | Five score scale | 3 | 3 | 2 | 2 | 3 | 3 | 3 | 4 | 3 | 3 | 4 | 4 | 3 | 4 | 3 | 2 |

TABLE 3

| Results of tester B | | | | | | | | | | | | | | | | | | |
|---|---|---|---|---|---|---|---|---|---|---|---|---|---|---|---|---|---|---|
| | | | Comparative Example | | | | Example 1 | | | | Example 2 | | | | Example 3 | | | |
| | | | Neu-tral | Hook 1 | Hook 2 | Hook 3 | Neu-tral | Hook 1 | Hook 2 | Hook 3 | Neut-ral | Hook 1 | Hook 2 | Hook 3 | Neu-tral | Hook 1 | Hook 2 | Hook 3 |
| | Position | | NU | Fa | Fb | Fc | N1 | F1 | F2 | F3 | N1 | F1 | F2 | F3 | N1 | F1 | F2 | F3 |
| Head | Loft angle | deg | 11 | 11.9 | 12.6 | 12.8 | 11 | 11 | 11 | 11 | 11 | 11 | 11 | 11 | 11 | 11 | 11 | 11 |
| | Lie angle | deg | 59 | 58.8 | 58.2 | 57.5 | 59 | 59 | 59 | 59 | 59 | 59 | 59 | 59 | 59 | 59 | 59 | 59 |
| | Hook angle | deg | 1 | 2.5 | 3.4 | 3.9 | 1 | 1 | 1 | 1 | 1 | 1 | 1 | 1 | 1 | 1 | 1 | 1 |
| Shaft | Bending torsional amount | deg | 0 | 0 | 0 | 0 | 1.0 | 1.0 | 1.0 | 1.0 | 2.5 | 2.5 | 2.5 | 2.5 | 4.5 | 4.5 | 4.5 | 4.5 |
| | Inclination of shaft axis | deg | 1.5 | 1.5 | 1.5 | 1.5 | 0 | 0 | 0 | 0 | 0 | 0 | 0 | 0 | 0 | 0 | 0 | 0 |
| Attainment point of ball | Distance | yard | 174 | 175 | 177 | 179 | 177 | 178 | 181 | 182 | 174 | 179 | 182 | 186 | 176 | 179 | 188 | 182 |
| | Horizontal deviation | yard | right 23 | right 16 | right 5 | right 2 | right 25 | right 20 | right 17 | right 15 | right 27 | right 17 | right 10 | right 4 | right 25 | right 12 | left 1 | left 7 |
| Sensory evaluation | Ease to address | Five score scale | 5 | 2 | 1 | 1 | 5 | 5 | 5 | 5 | 5 | 5 | 5 | 5 | 5 | 5 | 5 | 5 |
| | Horizontal directionality | Five score scale | 2 | 3 | 3 | 3 | 2 | 3 | 3 | 3 | 2 | 3 | 3 | 4 | 2 | 3 | 4 | 3 |

;l

TABLE 4

| Results of tester C | | | | | | | | | | | | | | | | | | |
|---|---|---|---|---|---|---|---|---|---|---|---|---|---|---|---|---|---|---|
| | | | Comparative Example | | | | Example 1 | | | | Example 2 | | | | Example 3 | | | |
| | | | Neu-tral | Slice 1 | Slice 2 | Slice 3 | Neu-tral | Slice 1 | Slice 2 | Slice 3 | Neu-tral | Slice 1 | Slice 2 | Slice 3 | Neu-tral | Slice 1 | Slice 2 | Slice 3 |
| | Position | | NU | Sa | Sb | Sc | N1 | S1 | S2 | S3 | N1 | S1 | S2 | S3 | N1 | S1 | S2 | S3 |
| Head | Loft angle | deg | 11 | 10.2 | 9.5 | 9.3 | 11 | 11 | 11 | 11 | 11 | 11 | 11 | 11 | 11 | 11 | 11 | 11 |
| | Lie angle | deg | 59 | 58.8 | 58.2 | 57.5 | 59 | 59 | 59 | 59 | 59 | 59 | 59 | 59 | 59 | 59 | 59 | 59 |
| | Hook angle | deg | 1 | −0.5 | −1.4 | −1.9 | 1 | 1 | 1 | 1 | 1 | 1 | 1 | 1 | 1 | 1 | 1 | 1 |
| Shaft | Bending torsional amount | deg | 0 | 0 | 0 | 0 | 1.0 | 1.0 | 1.0 | 1.0 | 2.5 | 2.5 | 2.5 | 2.5 | 4.5 | 4.5 | 4.5 | 4.5 |
| | Inclination of shaft axis | deg | 1.5 | 1.5 | 1.5 | 1.5 | 0 | 0 | 0 | 0 | 0 | 0 | 0 | 0 | 0 | 0 | 0 | 0 |
| Attainment point of ball | Distance | yard | 221 | 225 | 227 | 218 | 226 | 230 | 232 | 235 | 224 | 237 | 231 | 226 | 223 | 233 | 221 | 214 |
| | Horizontal deviation | yard | left 12 | left 6 | right 3 | right 7 | left 11 | left 6 | left 5 | left 2 | left 13 | left 3 | right 6 | right 9 | left 14 | right 2 | right 14 | right 19 |

TABLE 4-continued

| Results of tester C | | | | | | | | | | | | | | | | | | |
|---|---|---|---|---|---|---|---|---|---|---|---|---|---|---|---|---|---|---|
| | | | Comparative Example | | | | Example 1 | | | | Example 2 | | | | Example 3 | | | |
| | | | Neutral | Slice 1 | Slice 2 | Slice 3 | Neutral | Slice 1 | Slice 2 | Slice 3 | Neutral | Slice 1 | Slice 2 | Slice 3 | Neutral | Slice 1 | Slice 2 | Slice 3 |
| Sensory evaluation | Ease to address | Five score scale | 5 | 5 | 2 | 1 | 5 | 5 | 5 | 5 | 5 | 5 | 5 | 5 | 5 | 5 | 5 | 5 |
| | Horizontal directionality | Five score scale | 2 | 3 | 3 | 2 | 2 | 2 | 3 | 4 | 2 | 4 | 3 | 3 | 2 | 4 | 3 | 2 |

TABLE 5

| Results of tester D | | | | | | | | | | | | | | | | | | |
|---|---|---|---|---|---|---|---|---|---|---|---|---|---|---|---|---|---|---|
| | | | Comparative Example | | | | Example 1 | | | | Example 2 | | | | Example 3 | | | |
| | | | Neutral | Slice 1 | Slice 2 | Slice 3 | Neutral | Slice 1 | Slice 2 | Slice 3 | Neutral | Slice 1 | Slice 2 | Slice 3 | Neutral | Slice 1 | Slice 2 | Slice 3 |
| | Position | | NU | Sa | Sb | Sc | N1 | S1 | S2 | S3 | N1 | S1 | S2 | S3 | N1 | S1 | S2 | S3 |
| Head | Loft angle | deg | 11 | 10.2 | 9.5 | 9.3 | 11 | 11 | 11 | 11 | 11 | 11 | 11 | 11 | 11 | 11 | 11 | 11 |
| | Lie angle | deg | 59 | 58.8 | 58.2 | 57.5 | 59 | 59 | 59 | 59 | 59 | 59 | 59 | 59 | 59 | 59 | 59 | 59 |
| | Hook angle | deg | 1 | −0.5 | −1.4 | −1.9 | 1 | 1 | 1 | 1 | 1 | 1 | 1 | 1 | 1 | 1 | 1 | 1 |
| Shaft | Bending torsional amount | deg | 0 | 0 | 0 | 0 | 1.0 | 1.0 | 1.0 | 1.0 | 2.5 | 2.5 | 2.5 | 2.5 | 4.5 | 4.5 | 4.5 | 4.5 |
| | Inclination of shaft axis | deg | 1.5 | 1.5 | 1.5 | 1.5 | 0 | 0 | 0 | 0 | 0 | 0 | 0 | 0 | 0 | 0 | 0 | 0 |
| Attainment point of ball | Distance | yard | 198 | 199 | 201 | 201 | 197 | 199 | 204 | 206 | 197 | 203 | 209 | 207 | 199 | 208 | 201 | 198 |
| | Horizontal deviation | yard | left 19 | left 11 | left 5 | right 2 | left 18 | left 14 | left 9 | left 8 | left 21 | letf 10 | left 2 | right 4 | left 20 | left 4 | right 10 | right 16 |
| Sensory evaluation | Ease to address | Five score scale | 4 | 5 | 3 | 2 | 4 | 4 | 4 | 4 | 4 | 4 | 4 | 4 | 4 | 4 | 4 | 4 |
| | Horizontal directionality | Five score scale | 2 | 2 | 3 | 3 | 2 | 2 | 3 | 4 | 2 | 3 | 4 | 4 | 2 | 4 | 3 | 3 |

TABLE 6

| Results of tester E | | | | | | | | | | | | | | | | | | |
|---|---|---|---|---|---|---|---|---|---|---|---|---|---|---|---|---|---|---|
| | | | Comparative Example | | | | Example 1 | | | | Example 2 | | | | Example 3 | | | |
| | | | Neutral | Hook 1 | Hook 2 | Hook 3 | Neutral | Hook 1 | Hook 2 | Hook 3 | Neutral | Hook 1 | Hook 2 | Hook 3 | Neutral | Hook 1 | Hook 2 | Hook 3 |
| | Position | | NU | Fa | Fb | Fc | N1 | F1 | F2 | F3 | N1 | F1 | F2 | F3 | N1 | F1 | F2 | F3 |
| Head | Loft angle | deg | 11 | 11.9 | 12.6 | 12.8 | 11 | 11 | 11 | 11 | 11 | 11 | 11 | 11 | 11 | 11 | 11 | 11 |
| | Lie angle | deg | 59 | 58.8 | 58.2 | 57.5 | 59 | 59 | 59 | 59 | 59 | 59 | 59 | 59 | 59 | 59 | 59 | 59 |
| | Hook angle | deg | 1 | 2.5 | 3.4 | 3.9 | 1 | 1 | 1 | 1 | 1 | 1 | 1 | 1 | 1 | 1 | 1 | 1 |
| Shaft | Bending torsional amount | deg | 0 | 0 | 0 | 0 | 1.0 | 1.0 | 1.0 | 1.0 | 2.5 | 2.5 | 2.5 | 2.5 | 4.5 | 4.5 | 4.5 | 4.5 |
| | Inclination of shaft axis | deg | 1.5 | 1.5 | 1.5 | 1.5 | 0 | 0 | 0 | 0 | 0 | 0 | 0 | 0 | 0 | 0 | 0 | 0 |
| Attainment point of ball | Distance | yard | 194 | 193 | 187 | 189 | 195 | 199 | 201 | 205 | 196 | 206 | 209 | 200 | 193 | 206 | 199 | 196 |
| | Horizontal deviation | yard | right 14 | right 12 | right 13 | right 11 | right 13 | right 8 | right 5 | right 2 | right 13 | right 2 | left 5 | left 10 | right 16 | right 2 | left 11 | left 18 |
| Sensory evaluation | Ease to address | Five score scale | 5 | 4 | 3 | 3 | 5 | 5 | 5 | 5 | 5 | 5 | 5 | 5 | 5 | 5 | 5 | 5 |
| | Horizontal directionality | Five score scale | 2 | 2 | 2 | 3 | 2 | 3 | 4 | 4 | 2 | 4 | 4 | 3 | 2 | 4 | 3 | 2 |

In the evaluation results of the tester A, the correcting effect of the slice caused by anisotropy is confirmed in the examples 1 to 3. The shaft having a greater bending torsional amount tends to generate the correcting effect of the slice. The correcting effect of the slice is changed depending on the position. Therefore, it is found that generation of torsion of the shaft is caused by a bending of the shaft accompanying a toe-down phenomenon. Even in the comparative example, the correcting effect of the slice caused by the hook angle is confirmed. However, the evaluation of the ease to address is comparatively low, and the evaluation of the horizontal directionality is also comparatively low.

In the evaluation results of the tester B, similar tendency as that of the tester A is exhibited.

In the evaluation results of the tester C, the correcting effect of the hook caused by anisotropy is confirmed in the examples 1 to 3. The shaft having a greater bending torsional amount tends to generate the correcting effect of the hook. The correcting effect of the hook is changed depending on the position. Therefore, it is found that generation of torsion of the shaft is caused by a bending of the shaft accompanying a toe-down phenomenon. Even in the comparative example, the correcting effect of the hook caused by the hook angle is confirmed. However, the evaluation of the ease to address is comparatively low, and the evaluation of the horizontal directionality is also comparatively low.

In the evaluation results of the tester D, similar tendency as that of the tester C is exhibited.

In the evaluation results of the tester E, the correcting effect of the slice caused by anisotropy is confirmed in the examples 1 to 3. The shaft having a greater bending torsional amount tends to generate the correcting effect of the slice. The correcting effect of the slice is changed depending on the position. Therefore, it is found that generation of torsion of the shaft is caused by a bending of the shaft accompanying a toe-down phenomenon. In the comparative example, the correcting effect of the slice caused by the hook angle is small. This is because the tester E addresses without grounding the sole, and the effect caused by the hook angle is hard to obtain. In the comparative example, the evaluation of the ease to address is comparatively low, and the evaluation of the horizontal directionality is also comparatively low.

As shown in these Tables, the examples are superior to the comparative example. The advantages of the present invention are apparent.

The invention described above can be applied to all golf clubs.

The description hereinabove is merely for an illustrative example, and various modifications can be made in the scope not to depart from the principles of the present invention.

What is claimed is:

1. A method comprising:

configuring a golf shaft to exhibit a predetermined amount of torsional displacement based on a predetermined amount of shaft bending displacement resulting in a golf shaft having anisotropy.

2. The method of claim 1, further comprising configuring a golf shaft to exhibit a predetermined bending torsional amount.

3. The method of claim 2, wherein the predetermined bending torsional amount is greater than or equal to 0.5 degrees.

4. The method of claim 3, wherein the predetermined bending torsional amount is greater than or equal to 1.0 degree.

5. The method of claim 1, wherein the predetermined bending torsional amount is less than or equal to 5.0 degrees.

6. The method of claim 1, further comprising:

configuring the golf shaft to exhibit a first predetermined amount of torsional displacement based on the predetermined amount of shaft bending displacement when oriented in a first rotational position; and configuring the golf shaft to exhibit a second predetermined amount of torsional displacement based on the predetermined amount of shaft bending displacement when oriented in a second rotational position, wherein the first rotational location is different from the second rotational location, and the first predetermined amount of torsional displacement is different from the second predetermined amount of torsional displacement.

7. The method of claim 6, wherein the first predetermined amount of torsional displacement is a positive displacement value and the second predetermined amount of torsional displacement is a negative displacement value.

8. The method of claim 7, wherein:

the shaft comprises a shaft axis; and the first rotational position and the second rotational position are displaced from each other by about 180 degrees about the shaft axis.

9. The method of claim 1, further comprising forming the golf shaft from one or more prepreg sheets having fibers oriented at about 30 degrees relative to a tip-to-butt direction.

10. The method of claim 1, further comprising associating the shaft with a coupling adapted to interchangeably affix the shaft to a golf club head between a plurality of rotational orientations.

11. A method comprising:

configuring a golf shaft to exhibit a predetermined amount of torsional displacement based on a predetermined amount of shaft bending displacement resulting in a golf shaft having anisotropy; and configuring a golf club head to interchangeably receive the golf shaft between a plurality of rotational orientations with a mounting/detaching mechanism to form a complete golf club.

12. The method of claim 11, further comprising:

configuring the golf club head to include a receiving hole defining a central axis;

wherein the golf shaft defines a shaft axis that forms an angle θ1 with the central axis of 0 degrees.

13. The method of claim 11, further comprising configuring the shaft such that, when associated with the golf club head in at least one of the plurality of rotational orientations, a face-closing torsion is linked with a bending of the shaft accompanying a toe-down phenomenon.

14. The method of claim 11, further comprising configuring the golf club head and the golf shaft such that relocating the golf shaft among the plurality of rotational orientations does not affect at least one of a loft angle, a lie angle, and a hook angle of the golf club.

15. The method of claim 11, further comprising:

configuring the golf club head and the golf shaft such that, in a first circumferential orientation of the plurality of circumferential orientations, closing of the head is associated with bending of the golf shaft in impact accompanying toe-down phenomenon; and, in a second circumferential orientation of the plurality of circumferential orientations, opening of the head is associated with bending of the golf shaft in impact accompanying toe-down phenomenon.

16. The method of claim 15, wherein:

the shaft comprises a shaft axis; and the first rotational orientation and the second rotational orientation are displaced from each other by about 180 degrees about the shaft axis.

* * * * *